US005765913A

United States Patent [19]

LaPointe et al.

[11] Patent Number: 5,765,913

[45] Date of Patent: Jun. 16, 1998

[54] GLIDER CHAIR

[75] Inventors: Larry P. LaPointe, Temperance; Jonathan R. Saul, Erie; Richard E. Marshall, Monroe, all of Mich.

[73] Assignee: La-Z-Boy Incorporated, Monroe, Mich.

[21] Appl. No.: 872,540

[22] Filed: Jun. 10, 1997

Related U.S. Application Data

[63] Continuation of Ser. No. 633,626, Apr. 17, 1996, abandoned, which is a continuation-in-part of Ser. No. 533,829, Oct. 18, 1995, abandoned.

[51] Int. Cl.[6] ..... A47C 1/02; A47C 1/024; A47C 3/02

[52] U.S. Cl. ..... 297/281; 297/259.3; 248/370; 248/424

[58] Field of Search ..... 297/281, 282, 297/259.3, 258.1, 273; 248/370, 424

[56] References Cited

U.S. PATENT DOCUMENTS 2,302,387 11/1942 Greeno et al. .
2,683,481 7/1954 Lorenz .
3,096,121 7/1963 Knabusch et al. .
4,536,029 8/1985 Rogers .
4,591,205 5/1986 James .
4,700,920 10/1987 Horn .
5,222,286 6/1993 Saul et al. .
5,326,153 7/1994 Muffi .
5,328,235 7/1994 Saul et al. .
5,388,886 2/1995 LaPointe et al. .
5,427,433 6/1995 Holobaugh, Jr. .
5,435,621 7/1995 Komorowski et al. .
5,435,622 7/1995 Fay et al. .

*Primary Examiner*—Peter M. Cuomo
*Assistant Examiner*—Anthony D. Barfield
*Attorney, Agent, or Firm*—Harness, Dickey & Pierce, P.L.C.

[57] ABSTRACT

A glider chair including an improved glider linkage mechanism having a pair of front and rear glide links which are laterally preloaded such that non-precision bearing may be utilized. The glider chair further includes a rigid "box-like" chair frame surrounding the glider mechanism and having ample clearance therein so that extended glide links may be utilized to further provide a smooth and relatively flat glide motion while maintaining an appropriate height between the seat and floor.

53 Claims, 11 Drawing Sheets

FIG 1
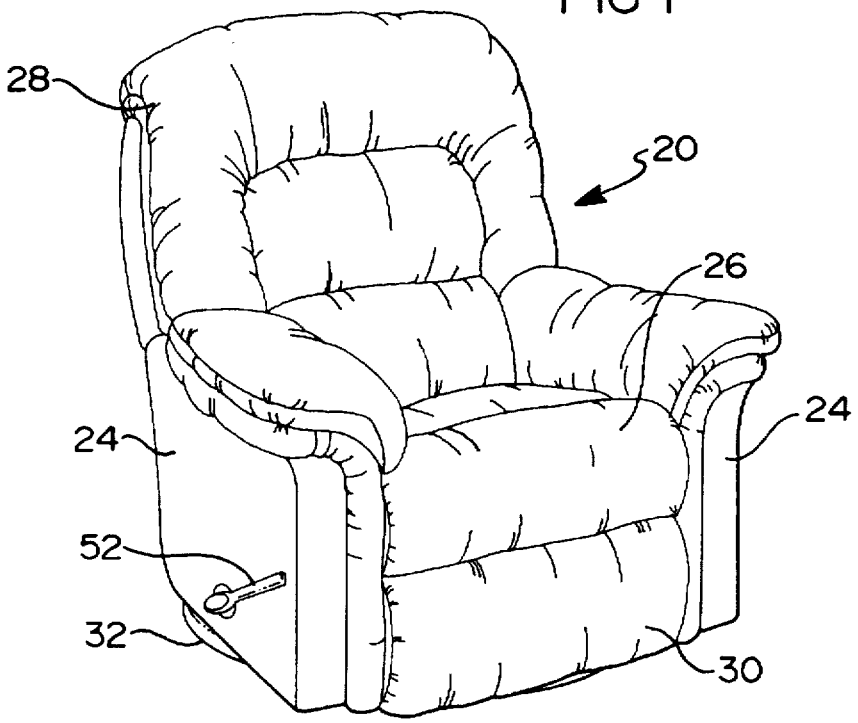
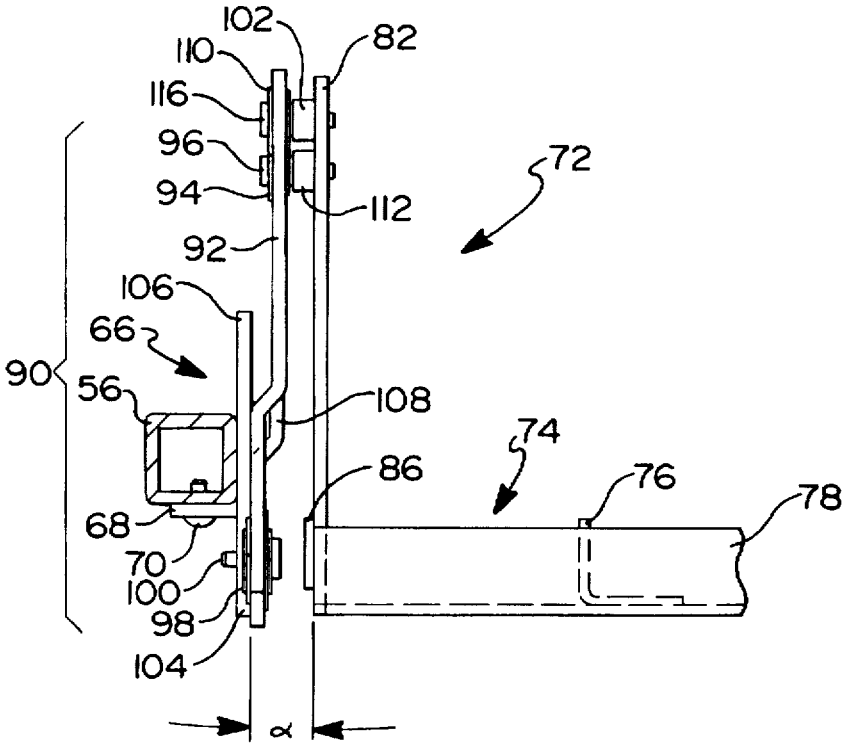
FIG 3

FIG 4
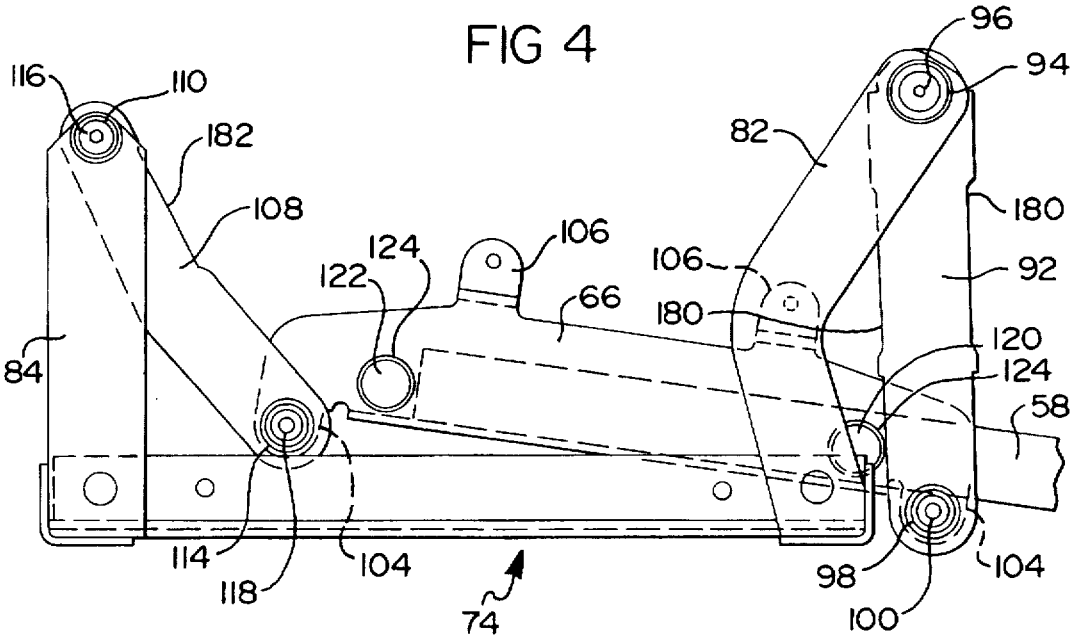
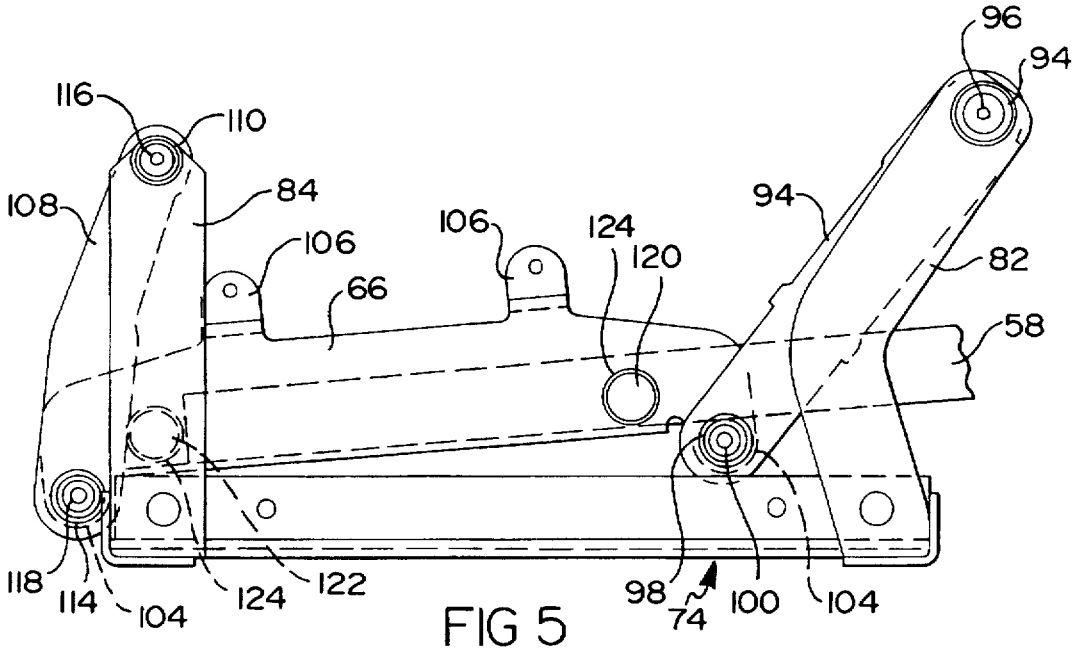
FIG 5

328
370
322
350
356
324
354
368
352
366
358
ℓ1
364
346
340
360
342
344
362
326
338
330
348
332
320
ℓ2
330
334
336

GLIDER CHAIR

CROSS-REFERENCE TO RELATED APPLICATION

This is a continuation of U.S. patent applciation Ser. No. 08/633,626, filed Apr. 17, 1996 and entitled "GLIDER CHAIR" now abandoned, which is a continuation-in-part of U.S. Ser. No. 08/533,829 filed on Oct. 18, 1995 and entitled "Glider Chair" now abandoned.

BACKGROUND OF THE INVENTION

1. Technical Field

The present invention relates to a glider chair having a glider mechanism for operatively coupling a chair frame to a stationary base, and more particularly to a glider chair including a modular chair frame, a base and a glider mechanism having a universal glide bracket and a pair of front and rear glide links operatively coupling the chair frame to the base.

2. Description of Related Art

Glider chairs are well known in the art and typically include a stationary base assembly which is laterally reinforced with cross braces to provide the necessary rigidity to support the chair frame for proper gliding movement. As such, these chairs are heavy, costly and the additional side-to-side bracing can interfere with or unduly limit the gliding movement of the chair. Furthermore, these mechanisms may require that the seat be situated substantially above the glide mechanism to provide adequate clearance for the gliding movement of the chair, thus requiring relatively short glide links to maintain the proper seating height. Accordingly, it would be desirable to provide a glider mechanism which eliminates such cross bracing while retaining the rigidity needed for supporting the chair frame and further to provide a glider mechanism with extended glide links resulting in a stable, smooth and relatively flat gliding motion.

Likewise, the chair frames of these glider chairs are relatively complicated in design and are typically assembled utilizing the "chair within a chair" construction which is known to be heavy and costly. An improved chair design has recently been developed for other types of comfort chairs, such as rockers, recliners, and combinations thereof, which overcomes the disadvantages traditionally associated with fabricating, assembling and upholstering these chairs. This improved design incorporates an integrated or "knock down" construction of the chair enabling unique fabrication and assembly techniques to be utilized which effectively result in increased production efficiency and cost savings while concomitantly producing a high quality article of furniture. Thus, it would be desirable to also provide a glider chair having a rigid "box-like" chair frame which adapts the concepts of the integrated or "knock down" chair construction into a modular chair frame construction technique for simplifying assembly thereof.

SUMMARY OF THE INVENTION

In accordance with the principles of the present invention, an improved glider chair is disclosed having an improved glider mechanism and whose chair frame readily lends itself to a modular construction technique. As a primary object of the present invention, an improved glider mechanism for an occasional chair is provided which suspends a chair frame above, but in close proximity to a stationary base. The glider mechanism includes a pair of front and rear glide links interdisposed between a universal glider bracket and a base glide assembly for supporting the chair frame for gliding motion with respect to the base. A simplified modular chair frame design is provided which is readily adaptable to the improved glider mechanism so as to significantly reduce the chair's overall complexity, weight and cost without sacrificing the chair's stiffness and rigidity, thus improving operation and comfort.

It is another object of the present invention to provide a glider chair which minimizes the noise and movement generated during gliding movement thereof.

It is a further object of the present invention to provide a glider mechanism having a cantilevered base assembly, cambered glide links and utilizing non-precision bearings which are laterally preloaded to provide a generally free-swinging glider mechanism.

It is still another object of the present invention to provide a glider mechanism having forward and rearward limits to prevent gliding movement of the chair frame with respect to the base assembly beyond a predetermined forward and rearward position.

BRIEF DESCRIPTION OF THE DRAWINGS

The various advantages of the present invention will become apparent to one skilled in the art by reading the following specification and subjoined claims and referencing the following drawings in which:

FIG. 1 is a perspective view of a glider chair supported on a swivel base in accordance with a preferred embodiment of the present invention;

FIG. 3 is a partial front view of a portion of the glide base assembly illustrating the cambered glide links of the present invention;

FIG. 4 is a side view of the glide link assembly shown in its forwardmost position;

FIG. 5 is a side view of the glide link assembly shown in its rearwardmost position;

DETAILED DESCRIPTION OF THE PREFERRED EMBODIMENT

Figure 2:
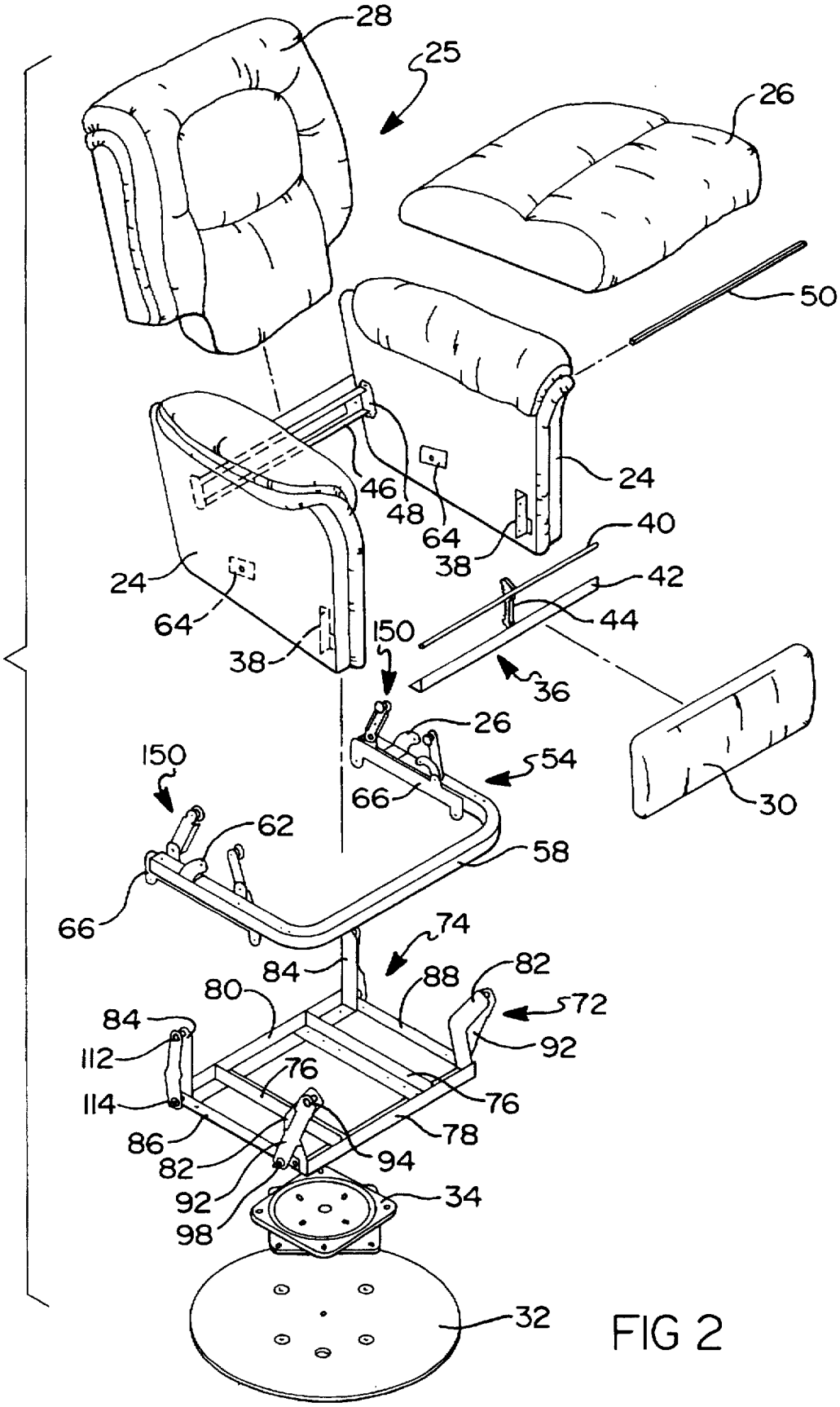
FIG. 2 is simplified exploded perspective view of a first preferred embodiment of the glider chair of the invention illustrating the swivel base and glider assembly of the present invention.

Referring to FIGS. 1 and 2, a glider chair 20 in accordance with a first preferred embodiment of the present invention is shown. The glider chair 20 generally includes a chair frame 22 having a pair of side walls 24, a seat member 26, a seat back 28 and a leg rest assembly 30 supported on a base 32 having a swivel plate 34 therebetween. With particular reference to FIG. 2, a pair of side walls 24 are coupled together with a front support member 36 and a rear support member 46. The front support member 36 includes a pair of end brackets 38 secured to an inner wall portion of the side walls 24, a support shaft 40 which is suspended from an upper portion of the end brackets, and a lower rail 42 secured to a lower portion of the end bracket and extending therebetween. A center bracket 44 extends between the support shaft and the lower rail to provide additional stiffness to the front support member 36. The rear support member 46 is generally C-shaped having a flange 48 formed on each end for securing the rear support member to the inner wall portion of the side walls 24. A drive rod 50 having a handle 52 disposed on one end is suspended between the side walls 24 and provides means for selectively operating various comfort features functions of the glide chair. Further description of a preferred embodiment of the knock-down chair and a method of assembly is the subject of U.S. Pat. No. 5,475,621 issued Jul. 25, 1995 entitled "Modular Rocking Chair and Method", which is commonly owned by the assignee of the present invention and the disclosure of which is expressly incorporated by reference herein.

A chair glide assembly 54 is pivotally coupled to the side walls 24 and interconnects the chair frame 22 with the base glide assembly 72 and the base 32. The chair glide assembly 54 includes a U-shaped tubular subframe 58 having a pair of longitudinal portions which are generally parallel to the side walls interconnected by a center portion. A pair of main pivot brackets 62 are attached to and extend upwardly from a rear portion of the tubular subframe 58. A pair of corresponding main pivot mounts 64 are secured to an inner surface of the side walls 24 and pivotally connect the chair glide assembly 54 to the chair frame 22. Thus, the chair frame 22 is supported on and pivotally coupled to the chair glide assembly 54 for angular tilting movement therebetween. A universal glide bracket 66 is disposed on an inboard wall of the longitudinal portions of the tubular subframe 58 to couple the chair glide assembly 54 to a base glide assembly 72. An outwardly extending flange 68 formed on the universal glide bracket 66 extends underneath the tubular subframe 58 and further supports the weight of the glider chair 20 and a seat occupant, as seen in FIG. 3. The tubular subframe 58 is attached to the universal glide bracket 66 by threaded fasteners 70 extending through the outwardly extending flange 68 and into the tubular subframe 58 and which are easily accessible from the bottom of the glider chair 20 during assembly. The universal glide bracket 66 further provides locations of operably coupling the glide links 92, 108, glide limits 120, 122 and the glide stop assembly 150 to the chair frame 22 as further described hereafter.

The base glide assembly 72 suspends the chair frame 22 and chair glide assembly 54 above the base 32 and includes a support frame 74 operably coupled to the base 32 through the swivel plate 34 for enabling the glider chair 20 to be rotatably positionable with respect to the floor. A further description of a preferred embodiment of the swivel plate is the subject of U.S. Pat. No. 5,435,622 issued Jul. 25, 1995 entitled "Recliner/Rocker Having Preloaded Base Assembly" which is commonly owned by the assignee of the present invention and the disclosure of which is expressly incorporated by reference herein. A pair of inboard longitudinal support members 76 are secured to the swivel plate 34. The front and rear lateral support members 78, 80 are disposed on the ends of the inboard longitudinal support members 76 and extend laterally with respect to the chair frame 22. A pair of front glide uprights 82 and a pair of rear glide uprights 84 are rigidly secured to and cantilevered vertically upwardly from the ends of the front and rear lateral support members 78, 80. A pair of outboard longitudinal support members 86, 88 are secured to and extend longitudinally between lower portions of the front and rear glide uprights 82, 84. As presently preferred, the support frame 74 is constructed of simple angular steel members welded into a rigid frame structure with the outboard longitudinal support members 86, 88 providing additional rigidity to the support frame.

The chair frame 22 and chair glide assembly 54 are suspended for gliding movement (i.e., generally linear movement along a longitudinal axis and angular rotation about a lateral axis) above the base glide assembly 72 on a pair of four-bar linkages 90 operably coupled to the right and left sides of the base glide assembly 72. The right and left four-bar linkages 90 are mirror images of one another, accordingly, the right four-bar linkage is referred to as the four-bar linkage and further described herein. The four-bar linkage is defined by the support frame 74, the front glide link 92, the universal glide bracket 66 and the rear glide link 108 which defines the glider mechanism.

Referring now to FIGS. 3–5, the front glide link 92 includes an upper bearing 94 disposed within an upper portion thereof and is operably coupled to the front glide upright 82 for pivotal motion at the upper pivot pin 96. An upper spacer 102 is disposed between the upper bearing 94 and the front glide upright 82 to space the front glide link 92 laterally outwardly from the support frame 74. Similarly, the lower bearing 98 is disposed within a lower portion of the front glide link 92 and operably couples the front glide link 92 to a downwardly extending tab 104 formed on the universal glide bracket 66 for pivotal motion on the lower pivot pin 100. The rear glide link 108 is similar in design and function to the front glide link 92 and includes an upper and lower bearing 110, 114 pivotally coupling the rear glide link 108 to the rear glide upright 84 and the universal glide bracket 66 on the upper and lower pivot pins 116, 118 respectively. An upper spacer 112 is disposed between the upper bearing 110 and the rear glide upright 84 to space the rear glide link 108 laterally outwardly from the support frame 74.

The front and rear glide links 92, 108 are bent laterally outwardly to space the chair glide assembly 54 away from the base glide assembly 72 and provide sufficient clearance for unrestricted gliding motion of the chair frame 22 and chair glide assembly 54 with respect to the base glide assembly 72. As presently preferred, the glide uprights 82, 84 and universal glide bracket 66 include threaded apertures for receiving upper and lower pivot pins 96, 100, 116, 118 having a threaded portion thereon. Furthermore, as seen in FIG. 4, the front glide links 92 are interchangeable between the left and right side, thus simplifying manufacturing and reducing part inventory requirements and cost.

The upper and lower bearings 94, 110, 98, 114 in the front and rear glide link 108 are situated therein to provide a camber angle between the glide links and the uprights, as indicated by the angle a in FIG. 3. As presently preferred, a camber angle in the range of 2°–3° provides sufficient preloading without causing upper and lower bearings 94, 110, 98, 114 to bind. The laterally outwardly spaced glide links 92, 108 and cantilevered glide upright 82, 84, in addition to the camber angle therebetween enables non-precision ball bearings, i.e., bearings having tolerance range of approximately 0.001–0.010 inches, to be utilized for the upper and lower bearings 94, 110, 98, 114. More specifically, the weight of the chair frame 22 and a seat occupant therein causes the glide uprights 82, 84 to deflect at the cantilevered ends. This deflection in combination with the cambered, i.e., non-parallel, orientation of the glide links 92, 108 with respect to the glide uprights 82, 84 induce a lateral load on the four-bar linkage, i.e., the support frame 74, the front and rear glide links 92, 108 and the universal glide bracket 66, which preloads the bearings 94, 110, 98, 114 to remove the clearance and play therefrom and provide smooth gliding movement.

The present invention eliminates the need to provide upper cross braces extending laterally between upper portions of the left and right glide uprights 82, 84. The elimination of these upper cross braces affords addition clearance for gliding motion of the chair frame and its associated comfort feature described hereafter. While FIG. 3 illustrates the glide links 92, 108 spaced further outwardly at their lower portion, one skilled in the art will readily recognize that similar advantages could be achieved by spacing the glide links further outwardly at their upper portion. Furthermore, other aspects of the present invention could be practiced in a glider chair having parallel glide uprights and glide links or utilizing other pivotal support mechanism known in the art, such as precision bearings, bushings or riveted connections, to achieve the desired gliding motion.

The range of motion of the chair glide assembly is set by front and rear glide limits 120, 122 associated with the universal glide bracket 66. As seen in FIG. 4, the chair glide assembly 54 is shown in its forwardmost position. In this position the front glide limit 120 which extends inwardly from the universal glide bracket 66 engages an edge portion of the front glide link 92 to prevent further forward movement of the chair glide assembly 54. Similarly, as shown in FIG. 5, an edge portion of the rear glide link engages the rear glide limit 122, extending inwardly from the universal glide bracket 66, to limit rearward motion of the chair glide assembly 54. As presently preferred, the front and rear glide limits 120, 122 are metal studs extending inwardly from the universal glide bracket 66 and having a removable rubber cover 124 for engaging the edge portions of the respective glide links. It is intended that the removable rubber cover 124 be replaced after the rubber cover becomes worn during the normal course of usage.

With continued reference to FIGS. 4 and 5, the gliding movement of the present invention is illustrated. In the forwardmost position, the path of the chair frame as indicated by the tubular subframe 58 is oriented in an angularly downward fashion such that the forward portion of the tubular subframe 58 is lower relative to the base glide assembly 72 than the rearward portion of the tubular subframe 58. Thus, the chair frame 22 is tilted in a forward position. As the glider chair 20 is urged rearward by a seat occupant, the tubular subframe 58 rotates in a counterclockwise position as it translates rearward. Upon reaching the rear limit 122, the tubular subframe 58 has passed through a parallel condition with respect to the support frame 74 and reached a position wherein the rear portion of the tubular subframe 58 is situated closer to the base glide assembly 72 than the forward portion of the tubular subframe 58. Thus, the chair frame 22 is tilted in a rearward position. This type of combined linear and angular motion is believed to provide a soothing and comfortable motion. One skilled in the art will readily appreciate that the precise relationship between the linear and angular motion which defines the path of travel for the chair frame may be modified by varying the geometric relationship of the front and rear glide uprights, the front and rear glide links and the universal glide bracket. The present invention is readily adaptable to a wide range of chair styles and sizes in that the glider mechanism, which is self-contained within the chair glide assembly, base glide assembly, and base, is independent of the chair frame and additional comfort features integrated into the glider chair.

Figure 6:
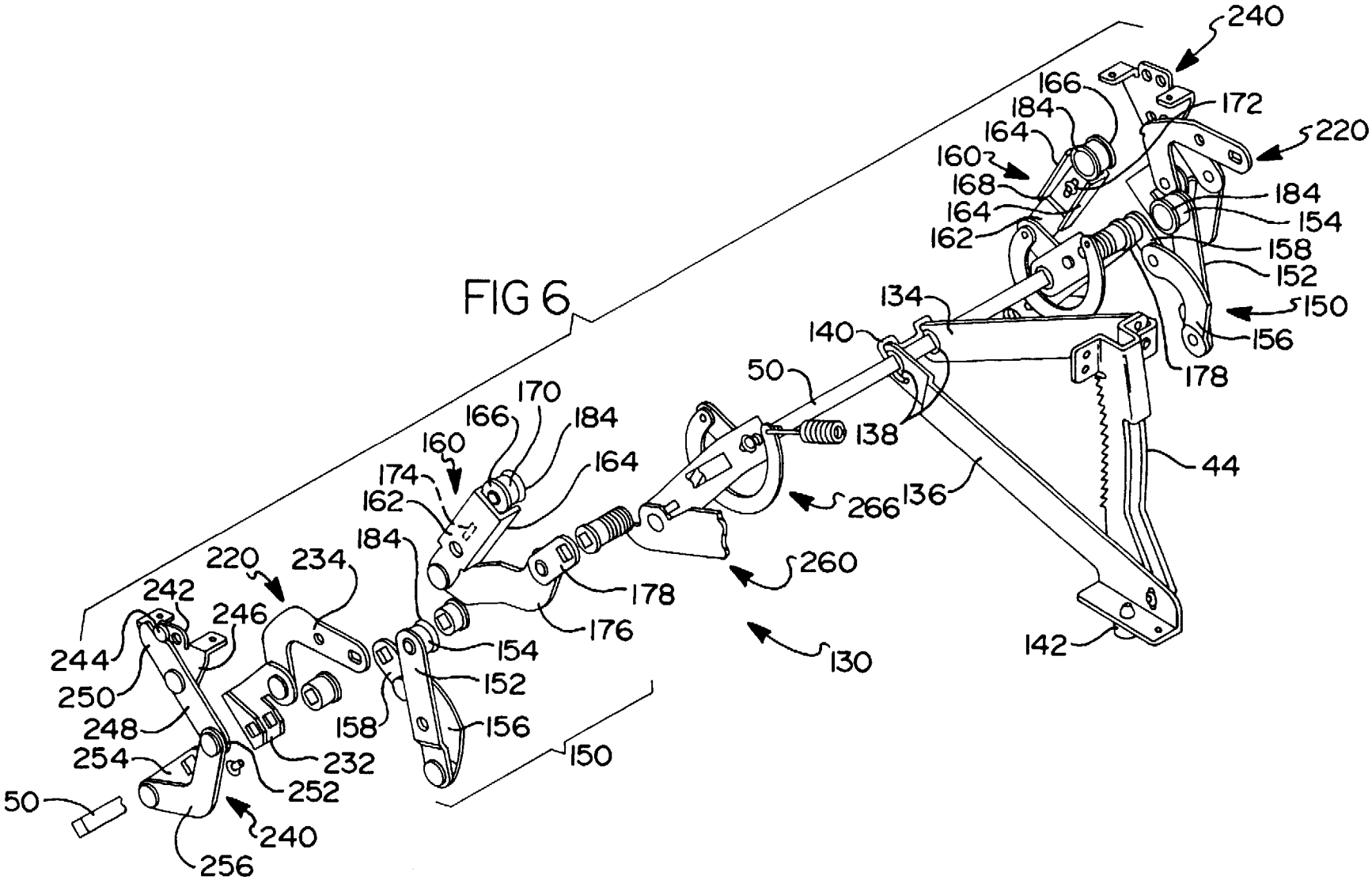
FIG. 6 is a perspective view of the drive rod assembly of the actuation mechanism of the present invention in a partially exploded and partially assembled condition.
Figure 7:
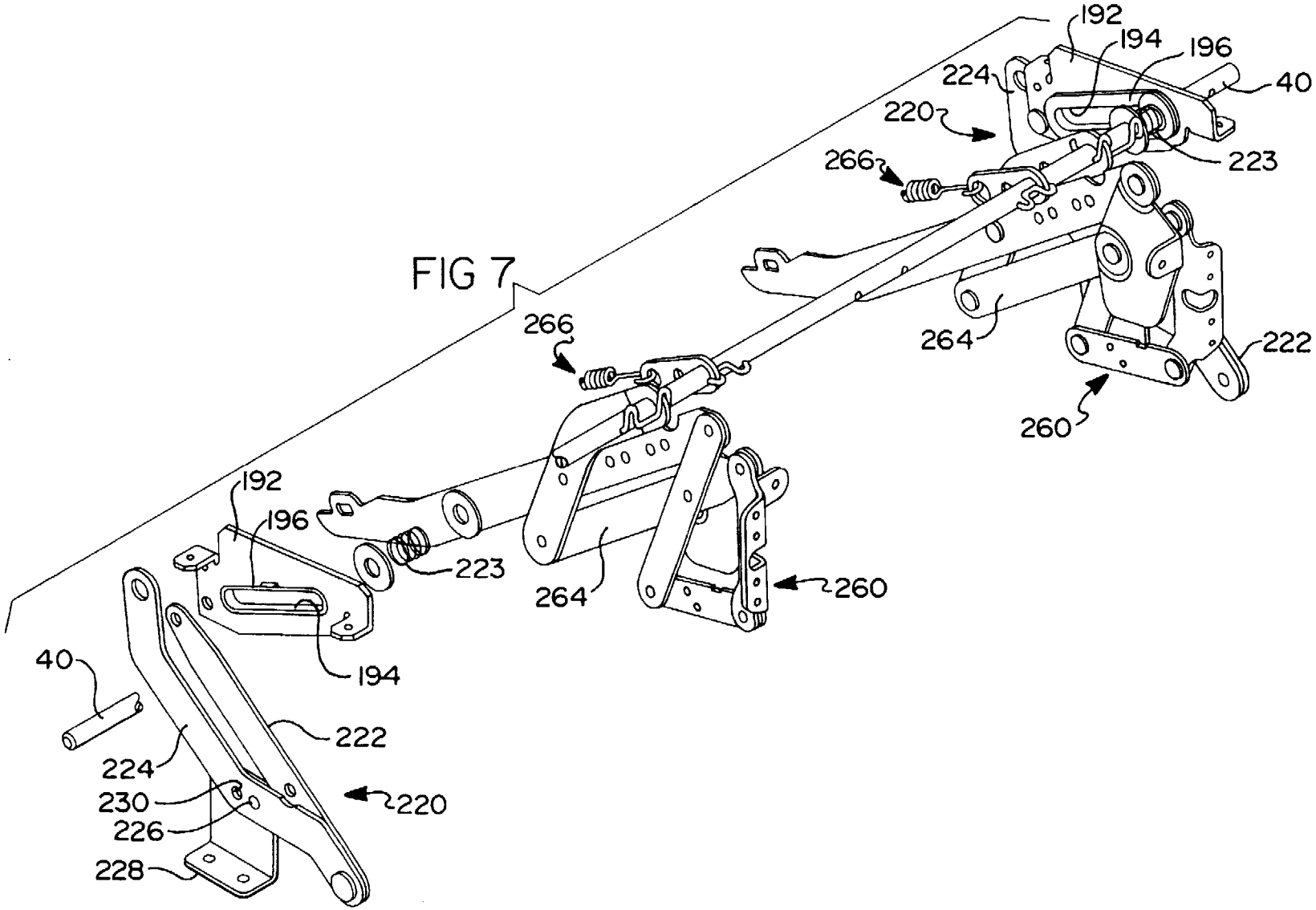
FIG. 7 is a perspective view illustrating the front support shaft, pantograph linkage, tilt control assembly and a portion of the swing link assembly of a preferred embodiment of the present invention in a partially exploded and partially assembled condition.
Figure 8:
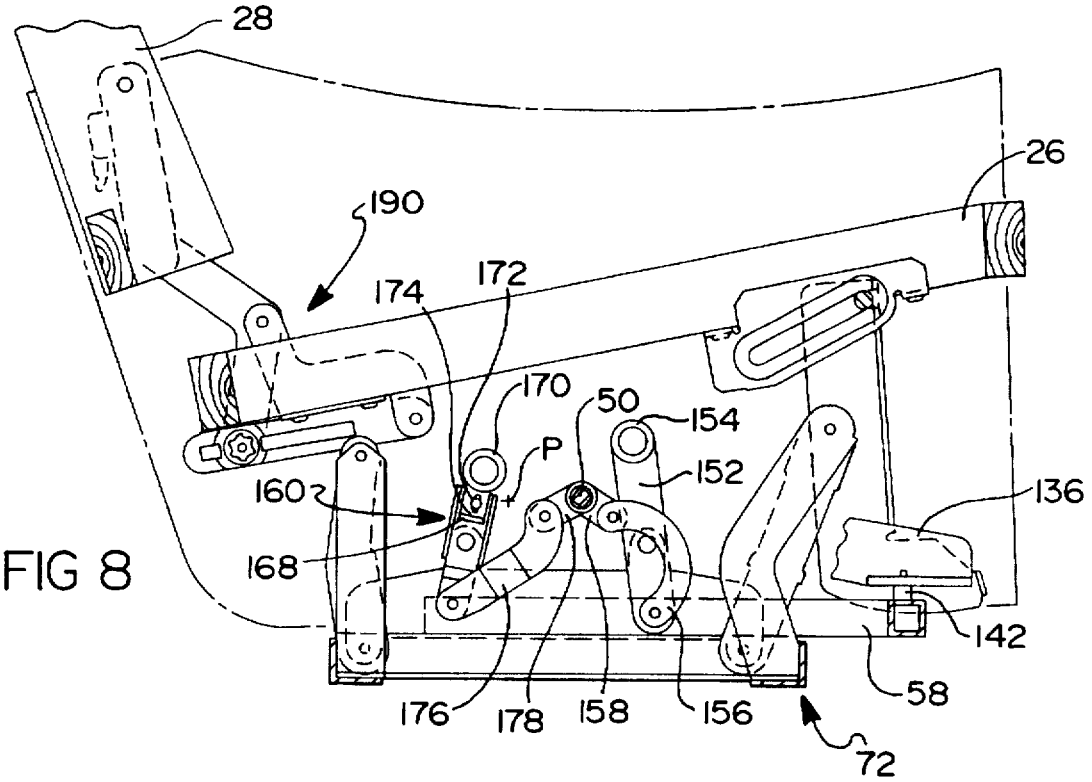
FIG. 8 is a side view of a glider chair in accordance with a preferred embodiment of the present invention illustrating the glide assembly and glide stop assembly in a disengaged position for permitting gliding movement of the glider chair.
Figure 9:
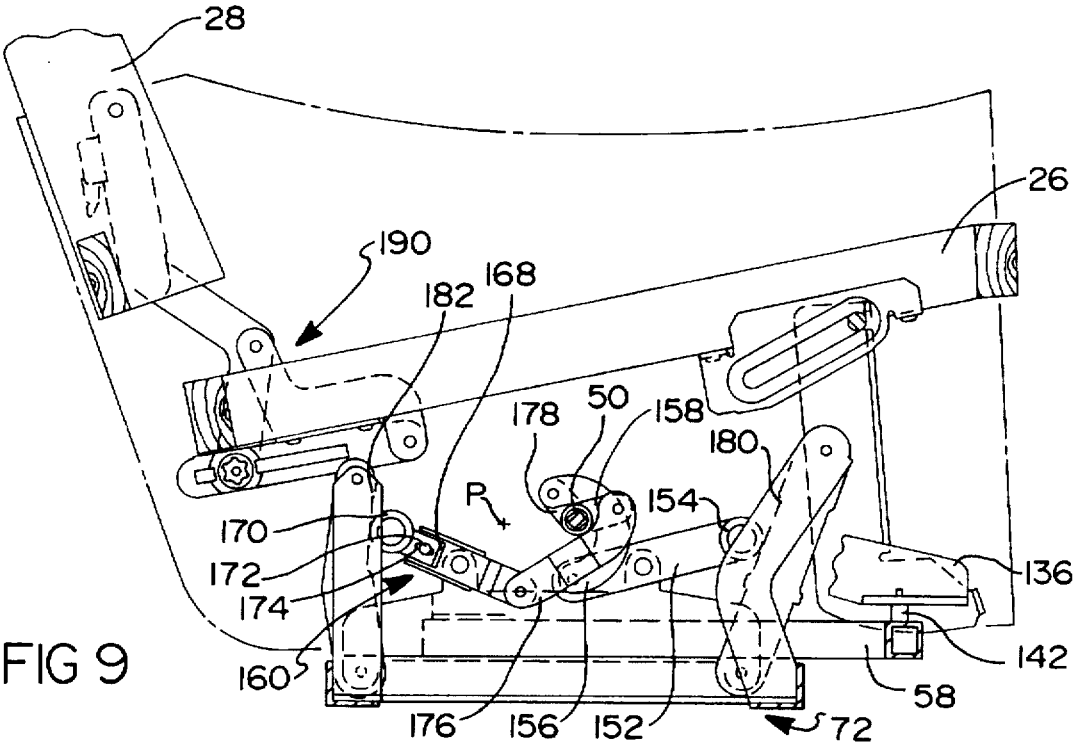
FIG. 9 is a side view of the glider chair of FIG. 8 illustrating the glide stop assembly in an engaged position for preventing gliding motion of the glider chair relative to the base.

In this regard, the glider chair 20 of the present invention may be readily adapted to include additional comfort features without significantly adding to the glider chair's complexity. For example, as shown in FIGS. 8 and 9, a glide stop assembly 150 is operably coupled to the drive rod 50 and provides means for selectively permitting or preventing the gliding motion of the chair. Similarly, as shown in FIGS. 10–11 and 13–14, a tilt control assembly 220 is operably coupled to the drive rod 50 and interconnected between the tubular subframe 58 and the chair frame 22 and provide means for tilting the chair frame 22 relative to the chair glide assembly 54. Referring to FIGS. 6–7 and 10–11, a swing link assembly 190 interconnects the seat assembly 25 to the side walls 24 and provides means for reclining the seat back 28 relative to the seat back 28. A seat lock assembly 240 is operably coupled to the drive rod 50 and provides means for locking out the reclining feature of the glider chair when in gliding mode. Also, as best seen in FIGS. 6 and 7, a leg rest assembly 260 is operably coupled to the drive rod 50 such that it is positionable between a retracted and extended position. Each of these features are further described in detail hereafter.

Referring now to FIGS. 6 and 7, the actuation mechanism 130 is assembled to include the drive rod 50 and the front support shaft 40, both of which are spatially oriented to be precisely located and suspended from the side walls 24. The upper and lower drive rod supports 134, 136 extend between the drive rod 50 and the front support shaft 40 to further stabilize the actuation mechanism 130. A rear portion of the upper drive rod support 134 is coupled to the drive rod 50 and laterally fixed thereto. A nylon bushing 138 interdisposed between the upper drive rod support 134 and the drive rod 50 permits rotational movement of the drive rod 50 therein while a spring clip 140 fixes the lateral location. The forward end of the upper drive rod support is secured to the center bracket 44 of the front support member 36. Similarly, the lower drive rod support 136 is secured to the drive rod 50 and a lower portion of the front support member 36. A rubber bumper 142 is disposed on the front support member 36 and extends downwardly to rest on the upper surface of the tubular subframe 58 when the chair is in a non-tilted position, as will be further described herein.

With continued reference to FIG. 6, a glide stop assembly 150 is provided which enables gliding movement of the glider chair to prevented. The glide stop assembly 150 of the present invention is independent of the glider mechanism, i.e., does not require an interconnection between the chair frame 22 and chair glide assembly 54. Thus, the glider chair 20 of the present invention eliminates the extra drag and added wear and tear associated with a lock out mechanism coupled between the chair and the base and which moves during gliding movement.

The glide stop assembly 150 includes left and right glide stop linkages 152 which are mirror images of one another as shown in an exploded view in the left portion of FIG. 6 and an assembled view in the right portion of FIG. 6. Each right and left glide stop linkage 152 includes a front glide stop link 152 pivotally connected at an intermediate pivot point to the front upwardly extending tab 106 formed on the universal glide bracket 66. The front connection link 156 and front drive link 158 operably couple the front glide stop link 152 to the actuation mechanism 130 for pivotally positioning a cam roller 154, disposed on the end of the front glide stop link 152, into engagement with the front glide link 92.

Similarly, the glide stop assembly includes a two-piece rear glide stop link 160 having a rear glide stop flange link 162 and a rear glide stop extension link 166 pivotally connected at an intermediate pivot point to the rear upwardly extending tab 106 formed on the universal glide bracket 66. The rear glide stop flange link 162 includes a pair of inwardly extending flanges 164 which capture the rear glide stop extension link 166. A bolt or threaded stud 172 extends from a middle portion of the rear glide stop flange link 162 for receiving a slot 174 formed in an intermediate portion of the extension link 168 to secure the extension link 166 to the flange link 162 while permitting adjustment of the length of the rear glide stop link 160. A tab 168 is formed on one end of the extension link 166 and a cam roller 170 is disposed on the opposite end. The rear connection link 176 and rear drive link 178 operably couple the rear glide stop flange link 162 to the actuation mechanism 130 for pivotally positioning the cam roller 170 into engagement with the rear glide link 108. The engagement point of the glide stop assembly 150 can be adjusted by modifying the length of the rear glide stop link 160.

Referring now to FIG. 8, the glider chair of the present invention is shown having the glide stop assembly 150 selectively positioned in an unlocked position. The front and rear glide stop links 152, 160 are pivotally positioned about the universal glide bracket 66 in a generally upward direction out of the way of the path of travel of the chair glide assembly 54. When it is desired to lock out the gliding motion of the glider chair 20, the drive rod 50 is rotated in a counterclockwise direction, as seen in FIG. 9, causing the glide stop assembly 150 to pivotally rotate the front and rear glide stop links 152, 160 towards a horizontal orientation so that the cam rollers 154, 170 engage the follower surfaces 180, 182 of the front and rear glide links 92, 108. The follower surfaces 180, 182 of the glide stop assembly 150 are machined such that the cam rollers 154, 170 engage the follower surfaces 180, 182 regardless of the position of the glider chair 20. In this way, the glide stop assembly 150 can lock out the gliding motion of the glider chair 20 in a smooth and continuous manner, regardless of the position of the glider chair. A beveled flange 184 formed on the inboard perimeter of the cam roller further ensures smooth and continuous engagement of the cam roller 154, 170 with the follower surface 180, 182 during glider lock out. Furthermore, the inwardly extending flanges 164 formed on the rear glide stop flange links 162 prevent the rear glide links 108 from becoming jammed with the rear glide stop link 160 when the chair frame 22 is in a reward position, thus ensuring smooth and continuous engagement of the glide stop assembly irrespective of the position of the chair frame relative to the base. In the locked position as shown in FIG. 9, the front and rear glide stop links 152, 160 resist pivotal movement of the front and rear glide links, thus preventing gliding motion of the glider chair.

With continued reference to FIGS. 7, 8 and 9, the swing link assembly 190 supports the seat assembly 25 from the side walls 24 such that the seat back 28 may be reclined with respect to the seat member 26. As seen in FIG. 7, the front portion of the seat assembly is supported from the side walls 24 by the support shaft 40. A front slide mount bracket 192 is secured at the forward portion of the seat member along a bottom surface thereof. The front slide mount brackets 192 include a lost motion slot 194 for guiding and limiting the fore aft motion of the seat assembly 25 on the support shaft 40. A nylon insert 196 is disposed within the lost motion slot 194 to facilitate sliding movement between the support shaft 40 and the front slide mount bracket 192. As seen in FIGS. 8 and 9, the rear swing mount bracket 198 is secured to a bottom portion of the seat member 26 for operably connecting the rear swing link assembly 200 to the seat member 26 and supporting a rear portion of the seat assembly 25. The rear swing link 204 is pivotally connected to an upstanding portion of the rear swing mount bracket 198. The rear swing mount bracket 198 further includes downwardly extending tabs 202 for interconnecting the friction slides 206 between the rear swing link 204 and the seat member 26. A retainer 208 having a pair of tabs 210 which extend through the friction slide 206 properly orient the friction slide 206. A thumb wheel 212 engages a threaded fastener 214 extending through the rear swing mount bracket 198, the friction slides 206 and the retainer 208 to secure the assembly together. The friction generated by the friction slides 206 can be adjusted with the thumb wheel 212 which increases or decreases the load between the friction slide 206 and the downward extending tab 202. The seat back connector bracket 216 secured to the seat back 28 engages an upper portion of the rear swing link 204 for detachably securing the seat back 28 to the swing link assembly 190. Further description of a preferred swing link assembly is the subject of U.S. Pat. No. 5,222,286 issued Jan. 13, 1992 entitled "Modular Reclining/Tilt Chair and Method of Making". Likewise, a metal seat assembly which may be readily incorporated into the present invention is the subject of U.S. patent application Ser. No. 08/319,672 filed Oct. 12, 1994, entitled "Chair Seat Assembly and Method of Upholstering". The above-identified references, which are commonly owned by the assignee of the present invention, are expressly incorporated by reference herein.

Referring again to FIG. 7, a tilt control assembly 220 is interconnected between the tubular subframe 58 and the seat member 26 for tilting the chair frame 22 relative to the base glide assembly 72, i.e. rotating the chair frame about pivot point P. In a first preferred embodiment, the tilt control assembly 220 is operably coupled to the actuation mechanism 130 and the swing link assembly 190 for causing the tilting movement. The tilt control assembly 220 includes a generally straight lift link 222 pivotally connected to a rear portion of the front slide mount bracket 192 at an upper end and pivotally connected to a lift lever 224 at a lower end. The lift lever 224 is pivotally connected at a pivot point 226 intermediate the first and second ends of the lift lever 224 to the front pivot bracket 228 which is secured to the tubular subframe 58. A plurality of pivots locations are provided on the lift lever 224 and pivot bracket 228 for adjusting the amount of tilt control effectuated by the tilt control assembly 220. The second end of the lift lever 224 is operably coupled to the drive rod 50 such that rotation of the drive rod 50 causes tilting motion of the chair frame 22. More specifically, with reference to FIG. 6, the tilt control drive link 232 is secured to the drive rod 50 for rotation therewith. The tilt control connection link 234 is generally L-shaped and extends upwardly and over the drive rod to be pivotally connected to the second end of the lift lever 224.

Figure 10:
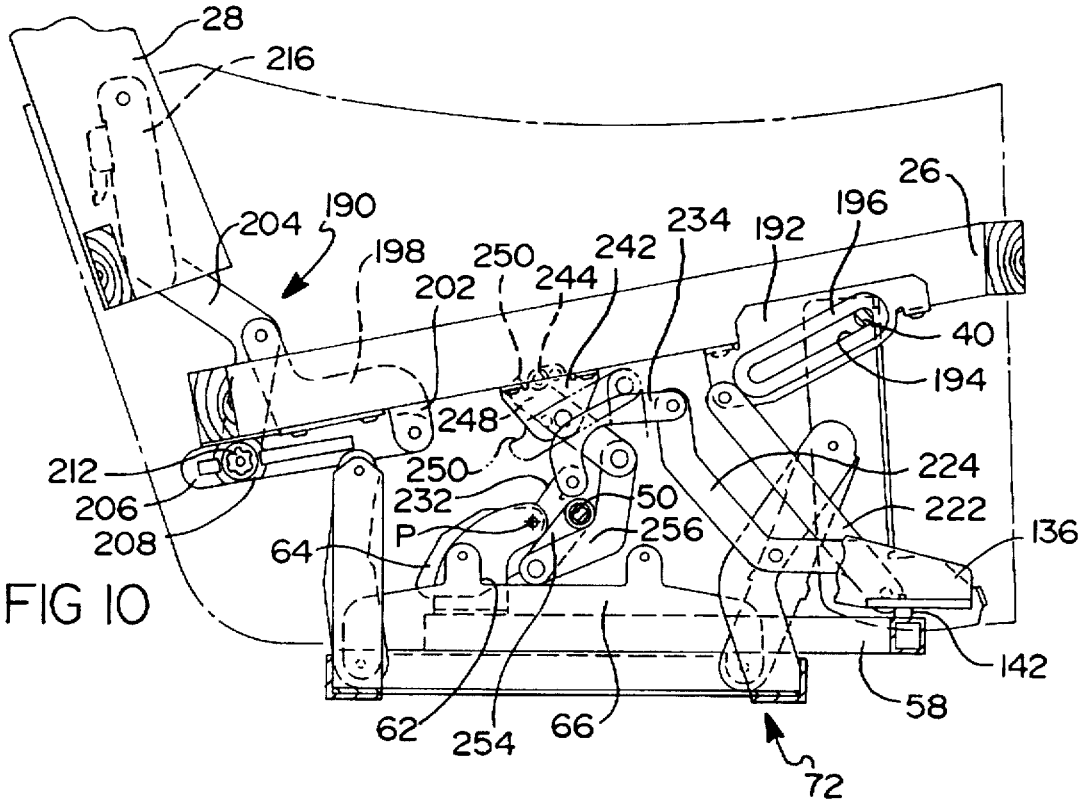
FIG. 10 is a side view of a glider chair in accordance with a preferred embodiment of the present invention having a tilt control assembly for tilting the chair frame with respect to the base assembly and having a seat lock assembly for selectively locking out the reclining motion of the seat back relative to the seat member, the glider chair illustrated in a non-tilted position with the seat assembly locked out.

The operation of the tilt control assembly 220 will now be described. Referring to FIG. 10, the glider chair 20 is illustrated in a non-tilted, non-reclined position. In this position, the front portion of the seat assembly 25 is supported by the front support member 36 which rests on a top portion of the tubular subframe 58 and by the main pivot brackets 62. The rubber bumper 142 is disposed between the front support member 36 and the tubular subframe 58 to eliminate undesirable movement and noise which may be generated by various links and pivots associated with the tilt control assembly 220 during gliding movement. More specifically, the rubber bumper 142 provides compliance between the front support member 36 and the tubular subframe 58 such that the weight of a seat occupant causes the rubber bumper 142 to compress which in turn slightly loads the pivots and links within the tilt control assembly 220 to eliminate unwanted movement therein. As presently preferred a rubber bumper having a durometer in the range of 60–80 and which compresses to a height approximately 50% of the uncompressed height when loaded provides the desired loading effects on the tilt control assembly.

Figure 11:
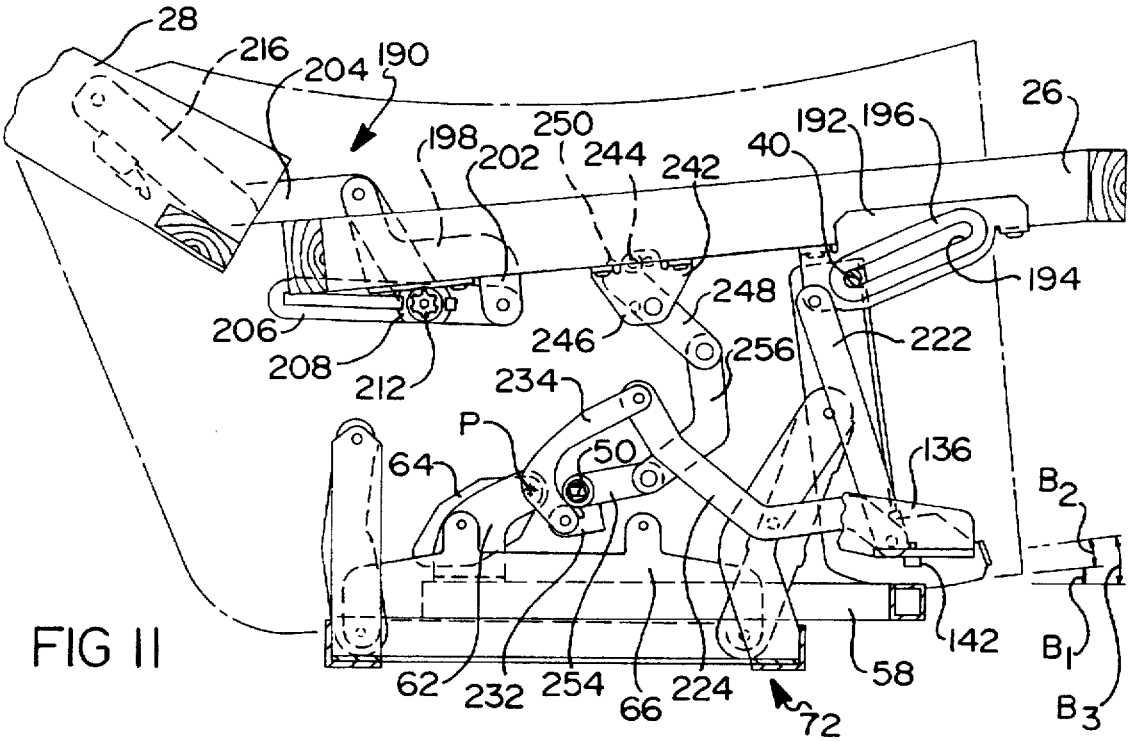
FIG. 11 is a side view of the glider chair of FIG. 10 illustrating the glider chair in a tilted position with the seat assembly unlocked.

Tilting movement is induced as the seat back 28 is reclined with respect to the seat member 26. The lift link 222 rotates about its pivotal connection in a clockwise direction (as seen in FIG. 11) to urge the front of the chair frame 22 upward and tilt chair frame 22 about pivot point P with respect to the base glide assembly 72 through an angle $\beta_1$. Additional tilting of the chair frame 22 can be achieved by rotation of the drive rod 50 in the counterclockwise direction which rotates the lift lever 224 in the counterclockwise direction about bracket pivot 230 to urge the lift link 222 in an upwardly direction which further tilts the chair frame 22 relative to the base glide assembly 72 through an angle $\beta_2$. The total tilting movement effectuated by reclining of the seat assembly 25 and actuation of the drive rod 50 is the sum, $\beta_3$, of each independent tilting movement, $\beta_1+\beta_2$. As presently preferred, the tilting movement of the chair frame 22 effectuated by reclining of the seat assembly 25 $\beta_1$, is approximately 4°, and the tilting movement of the chair frame 22 effectuated by the actuation mechanism 130, $\beta_2$, is approximately 7°. Accordingly, the tilt control assembly 220 enables the glider chair to be independently and cumulatively tilted a total of 11° in response to reclining movement of the seat assembly 25 and rotation of the drive rod 50. In the tilted position, the rubber bumper 142 is rotated out of engagement with the tubular subframe 58 and the weight of the seat occupant is supported through the tilt control pivot bracket and the main pivot bracket.

It is desirable, in certain circumstances, to provide a seat lock assembly 240 for preventing the reclining motion of the seat back 28 with respect to the seat member 26 when the glider chair 20 is in glide mode—for example, to maintain proper balance or to prevent interference with various assemblies. Referring again to FIG. 6, the seat lock assembly 240 includes a seat lock mount bracket 242 secured to the bottom portion of the seat member 26 and having a lock pin 244 extending outwardly therefrom. A seat lock stop link 248 is pivotally connected to a downwardly extending flange 246 of the seat lock mount bracket 242 and has an upper end 250 which is positionable to engage the lock pin 244. The second end 252 of the seat lock stop link 248 is operably coupled to the actuation mechanism 130 via the seat lock drive link 254 and seat lock connection link 258. The seat lock linkage, i.e., the stop link 248, the connection link 258 and the drive link 256 work in conjunction with the lock pin 244 to prevent forward movement of the seat member 26 relative to the actuation mechanism 130 and thus reclining movement of the seat assembly 25, in the following manner.

Referring to FIG. 10, the glider chair 20 is shown with the seat back 28 in a full upright position and the seat member 26 in a rearwardmost position. The drive rod 50 is in its full clockwise position. In this state, reclining movement of the seat back 28 is prevented by the seat lock stop link 248 which is pivotally connected to the seat lock mount bracket 242. More specifically, pressure applied to the seat back 28 causes the seat member 26 to slide forwardly which rotates the seat lock stop link 248 in a clockwise direction. The upper end 250 of the seat lock stop link 248 engages the lock pin 244 extending from the seat lock mount bracket 242 and prevents further movement of the seat member.

To permit reclining movement of the seat back 28 with respect to the seat member 26, the drive rod 50 is rotated in a counterclockwise direction causing the seat lock drive link 256 and connection link 258 to rotate the seat lock stop link 248 in a counterclockwise direction as shown in phantom lines in FIG. 10. The upper end 250 of the seat lock stop link 248 is rotated out of engagement from the lock pin 244 to permit the seat member 26 to be moved forwardly in conjunction with reclining of the seat back 28. As the seat assembly 25 is reclined, the pivot associated with the seat lock mount bracket 242 moves forwardly causing the seat lock stop link 248 to rotate in a clockwise direction. Further reclining of the seat back 28 rotates the seat lock stop link 248 about the pivot point until the upper end 250 of the seat lock stop link 248 engages the lock pin 244 once again when the seat assembly 25 is in its fully reclined position, as shown in FIG. 11.

Figure 12:
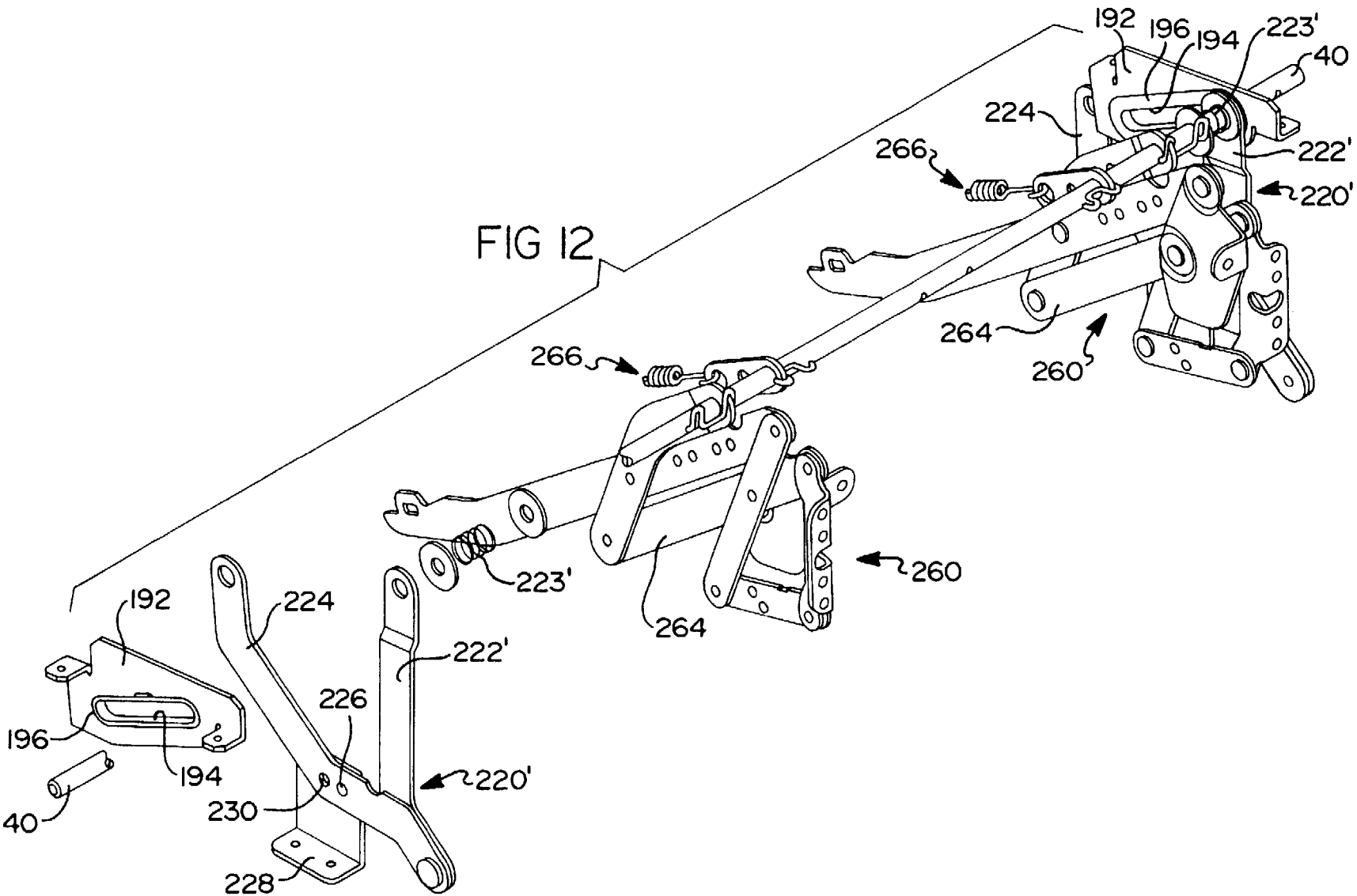
FIG. 12 is a perspective view similar to FIG. 6 illustrating an alternative preferred embodiment of the tilt control assembly of the present invention in a partially exploded and partially assembled condition.

In an alternate preferred embodiment, tilting movement is provided only upon selective manipulation of the actuation mechanism 130. As such, reclining movement of the seat assembly 25 no longer effectuates tilting movement of the chair frame 22 with respect to the base glide assembly 72. Referring now to FIG. 12, the tilt control assembly 220' of the alternate preferred embodiment is shown. Common elements between the two preferred embodiments are given identical reference numerals, while modified elements are given prime reference numerals. The main difference between the alternate preferred embodiments relates to the geometry of the lift link 222' and its interconnection with the chair frame 22. As best seen in FIG. 12, the lift link 222' is generally J-shaped having its upper end pivotally coupled about the support shaft 40 rather than the front slide mount bracket 192 as in the first preferred embodiment. More specifically, the front support shaft 40 is inserted through a first end of the lift link 222'. The spring 223' concentrically disposed over the front support shaft 40 urges the lift link 222' outwardly against the nylon insert 196 of the front slide mount bracket 192 to prevent the lift link 222' from rattling or otherwise making undesired noise during gliding movement of the glider chair 20. The lower end of the lift link 222' is pivotally connected to the lift lever 224' in a manner similar to the first preferred embodiment.

Figure 13:
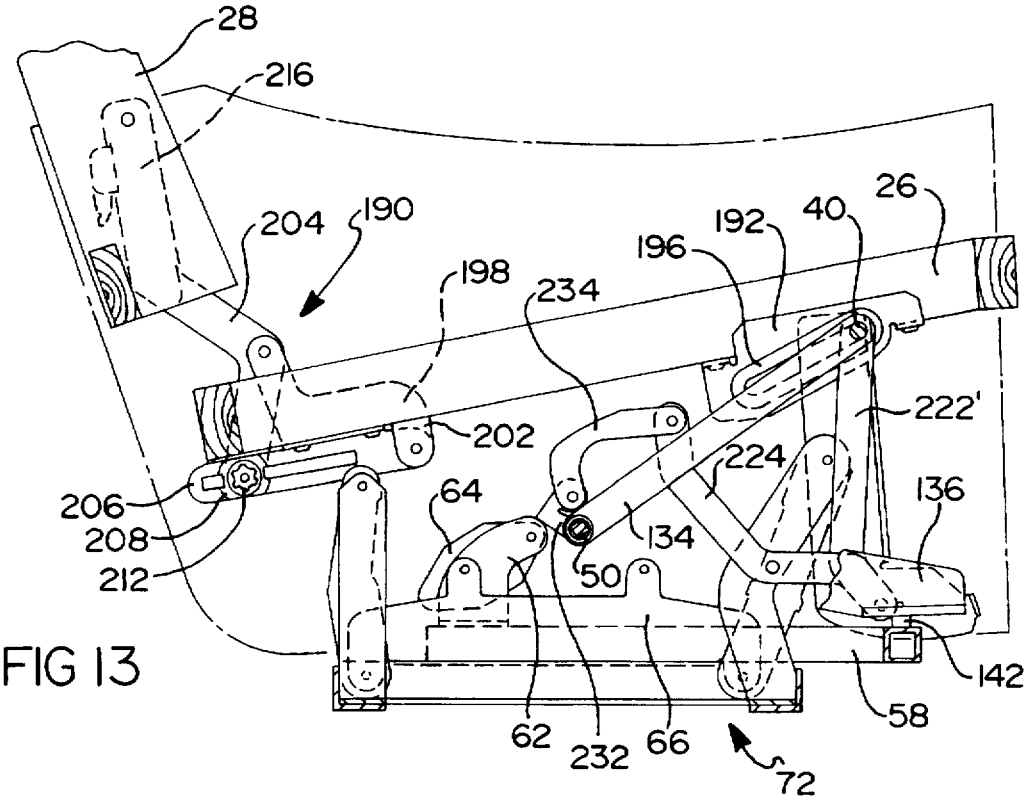
FIG. 13 is a side view of the glider chair shown in FIG. 12 illustrating the glider chair in a non-tilted position.
Figure 14:
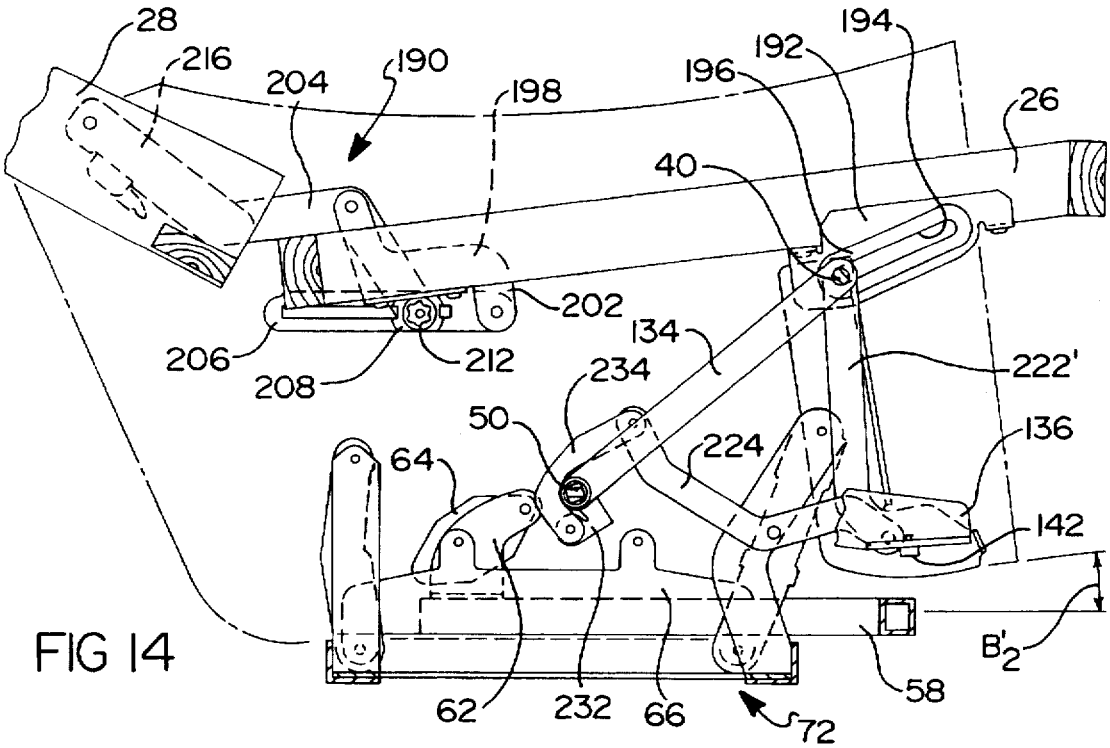
FIG. 14 is a side view of the glider chair shown in FIG. 13 illustrating the glider chair in a tilted position.

As best seen in FIGS. 13 and 14, operation of the tilt control assembly of the alternate preferred embodiment is shown. Initially, the chair is in a non-tilted position and the seat assembly may freely recline without tilting the glider chair. Unlike the first preferred embodiment, the seat lock assembly 240 is not provided, thus enabling the seat back 28 to recline, independent of the position of the actuation mechanism 130. Upon counterclockwise rotation of the drive rod 50, the tilt control drive link 256' and tilt control connection link 258' rotate the lift lever 224' in a counterclockwise direction causing the lift link 222' to urge the support shaft 40 upwardly to rotate the glider chair 20 frame about pivot P in a manner similar to the first preferred embodiment.

Referring now to FIGS. 7 and 12, a leg rest assembly 260 may be operably connected to the actuation mechanism 130 for positioning the leg rest assembly 260 between a retracted position and an extended position. The leg rest assembly 260 includes a leg rest frame board 262 having an outer surface that is padded and upholstered as shown in FIGS. 1 and 2. The frame board 262 is secured to and moved by left and right pantograph linkages 264 which are mirror images of one another. Left and right spring assist toggle assemblies 266 are provided which work coactively with leg rest pantograph linkages 264. The toggle assemblies 266 provide means for securely holding the frame board 262 of the leg rest assembly 260 in a fully retracted or fully extended position. The toggle assemblies 266 are overcenter mechanism which operate to supply a spring force for biasingly urging the leg rest assembly 260 towards its extended and retracted positions. The pantograph linkage 264 and toggle assemblies 266 may be similar in function and structure to that shown in FIG. 3 of U.S. Pat. No. 3,096,121, assigned to the common assignee of the present invention, with the exception that the pantograph linkages are operably suspended about the second set of "fixed" suspension points defined by the support shaft. Alternately, the pantograph linkages and toggle assemblies may be similar in function and structure to that shown in U.S. Pat. No. 5,388,886 issued Feb. 14, 1995 entitled "Dual Leg Rest Assembly" which is commonly owned by the assignee of the present invention. Reference may be made to the above-identified patents, the disclosures of which are expressly incorporated herein.

Referring now to FIGS. 15 through 18, a second preferred embodiment of the present invention is illustrated. Glider chair 320 is in the form of an occasional glider chair in which the seat assembly is fixedly secured to the chair frame, and therefore does not recline or tilt relative thereto. Except as discussed below, occasional glider chair 320 and the components utilized therein are in accordance with glider 20 previously described as the first preferred embodiment.

Figure 15:
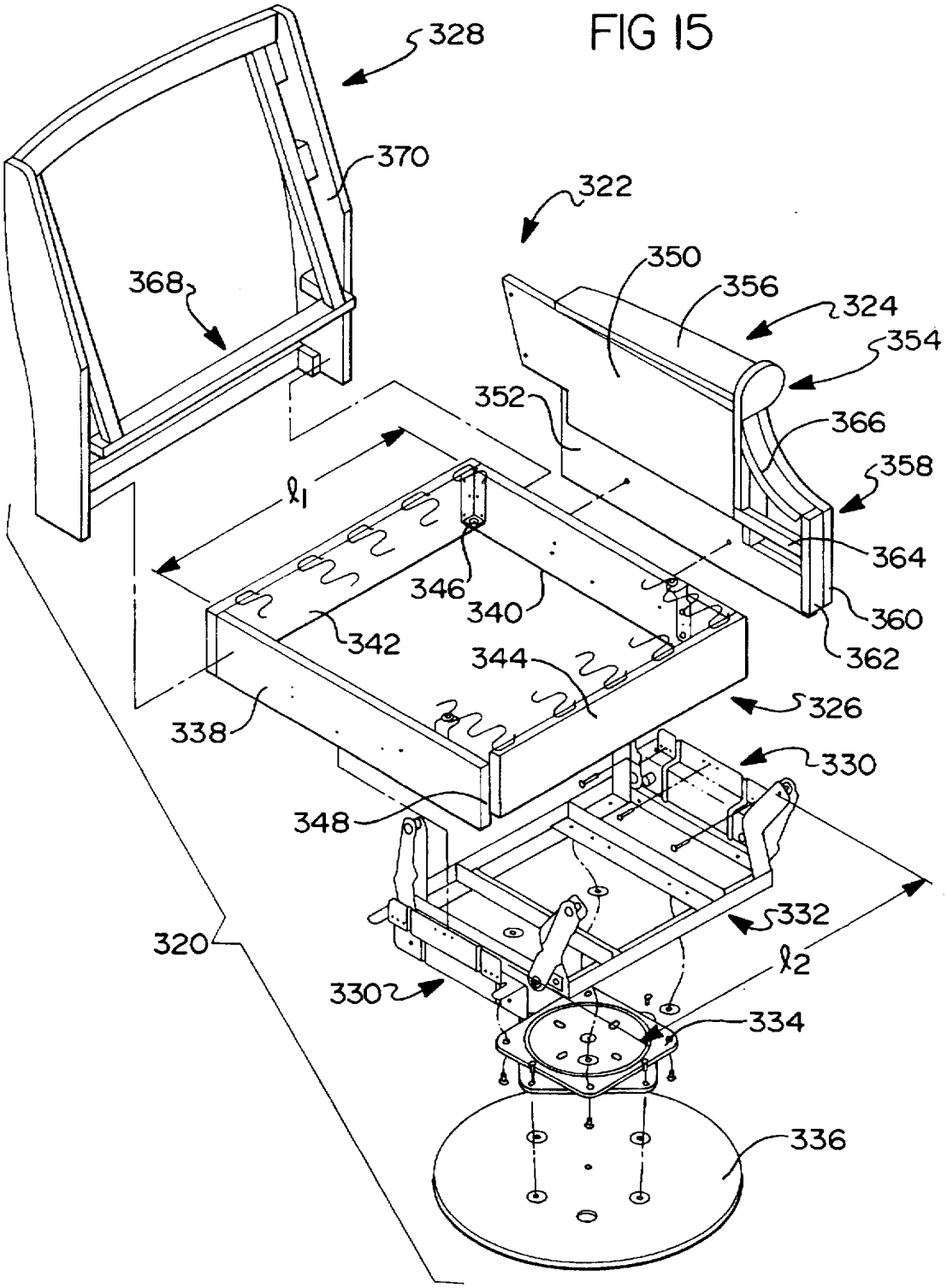
FIG. 15 is a simplified exploded perspective view of a second preferred embodiment of the invention illustrating a simplified chair frame coupled to a base with the improved glider mechanism of the present invention.

As best seen in FIG. 15, glider chair 320 generally includes chair frame 322 having left and right side walls 324 (the right side wall not being shown), seat deck 326 and seat back 328 secured together to form a rigid "box-like" chair frame structure. A pair of universal glide brackets 330 operably couple chair frame 322 to base glide assembly 332 for providing gliding movement between chair frame 322 and base 336. In this regard, base glide assembly 332, swivel plate 334, and base 336 are substantially identical to the base glide assembly 72, swivel plate 34 and base 32, respectively, of glider 20 illustrated in FIGS. 2 through 4 as discussed above.

With continued reference to FIG. 15, the components of chair frame 322 are assembled by interlocking the individual frame components, seat deck 326 forming the foundational structural element for chair frame 322. More specifically, seat deck 326 includes left and right side rails 338, 340 rear cross member 342 and front cross member 344. Universal corner bracket 346, a stamped steel bracket having three generally orthogonal flanges, is secured to seat deck members 338, 340, 342, 344 in each of the corners thereof with suitable fasteners. Front cross member 344 is positioned slightly vertically above left and right side rails 338, 340 and rear cross member 342 to provide a rearward inclination to seat deck 326. Furthermore, front cross member 344 is positioned slightly inboard of right and left side rails 338, 340 to form notch 348. In this manner, a very simple, yet extremely rigid seat deck 326 having a substantially open interior volume may be fabricated without the use of glue or dowel pins, thus greatly reducing the time required for assembly.

Side wall 324 includes inner side frame panel 350 secured to outer side frame panel 352. Armpost 354 and armrest 356 are secured to a forward edge of inner and outer side frame panel 350, 352. Forward panel assembly 358 which includes forward panel 360, front post 362, universal rail 364 and contoured filler panel 366 is secured to a front surface of armpost 354 and the inboard surface of forward panel 360. Seat back 328 includes inner seat back frame 368 supported within outer seat back frame 370.

During assembly of chair frame 322, left and right side walls 324 are secured to corresponding left and right side rails 338, 340 of seat deck 326 with suitable fasteners such that a lower, inner edge of each side wall 324 abuttingly engages the top surface of each side rail 338, 340. Further, an inboard corner of front post 362 is firmly secured within notch 348 formed between front cross member 344 and each side rail 338, 340. Seat back 328 interlocks with and is secured to a rearwardly extending portion of side wall 324 and also abuttingly engages a lower back portion thereof. In this manner, the components of chair frame 322, i.e., side walls 324, seat deck 326, and seat back 328, interlock with one another to form rigid "box-like" chair frame 322. While a fundamental description of the various components which make up chair frame 322 is disclosed above, a more detailed discussion of each of these components, as well as a preferred method of assembly is set forth in U.S. patent application Ser. No. 08/633,429 entitled "Modular Chair and Method" filed on Apr. 17, 1996 which is commonly owned by the assignee of the present invention, and the disclosure of which is expressly incorporated by reference herein.

Figure 18:
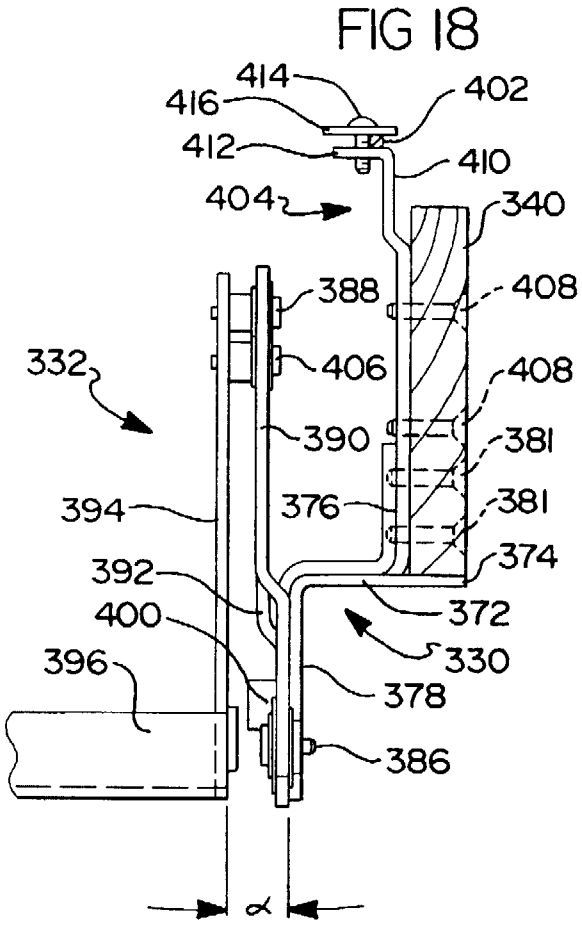
FIG. 18 is a front view of the glider mechanism shown in FIG. 15.
Figure 17:
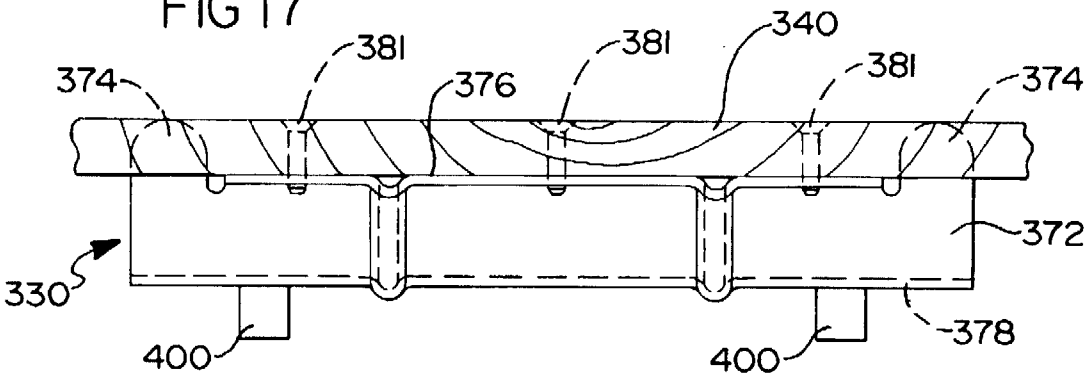
FIG. 17 is a top view of the universal glide bracket shown in FIG. 16.
Figure 16:
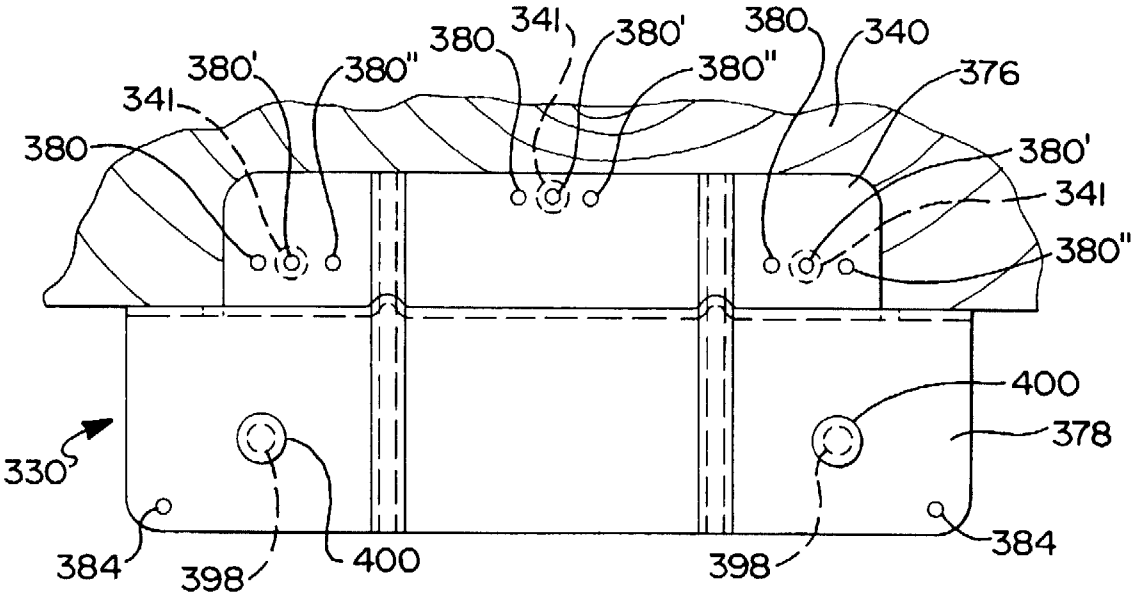
FIG. 16 is a side elevational view of the glider mechanism shown in FIG. 15, including the universal glide bracket of the glider mechanism secured to the seat deck of the modular chair frame.

Chair frame 322 is operably coupled to base glide assembly 332 by universal glide bracket 330. Unlike glider chair 20 of the first preferred embodiment, glider chair 320 does not provide tilting movement between chair frame 322 and base glide assembly 332. Accordingly, universal glide bracket 330 is designed to attach directly between chair frame 322 and base glide assembly 332. Referring now to FIGS. 16 through 18, universal glide bracket 330 includes horizontal surface 372 having a pair of horizontal tabs 374 extending outwardly therefrom. Tabs 374 acts as a horizontal supporting surface for a bottom edge of side rails 338, 340. Thus, tabs 374 provide a weigh bearing surface for transferring load from chair frame 322 through universal glide bracket 330 to base glide assembly 332, thereby reducing the shear stress on fasteners 381. Upper vertical flange 376 extends perpendicularly upwardly from horizontal surface 372, while lower vertical flange 378 extends perpendicularly downwardly from horizontal surface 372 and laterally inwardly offset from upper vertical flange 376. As best seen in FIG. 16, upper vertical flange 376 contains three sets of three apertures 380, 380', 380" formed therein which correspondingly align with a set of three bores 341 formed in left and right side rail 338, 340. Self-tapping, self-countersinking fasteners 381 extend through bores 341 and tap through apertures 380 for securing chair frame 322 to universal guide bracket 330. Apertures 380, 380', 380" permit chair frame 322 to be positioned in one of three forward/rearward location with respect to universal glide bracket 330, thereby allowing the balance point of glide chair 320 to be adjusted according to its styling and balance needs. Similarly, by accommodating forward/rearward adjustability in universal glide bracket 330, standard left and right side rails 338, 340 may be employed for a variety of chair styles and sizes.

Apertures 384 are formed in lower vertical flange 378 for receiving lower pivot pins 386 associated with front and rear glide links 390, 392 which operably couple universal glide bracket 330 with base glide assembly 332 to suspend chair frame 322 above base 336 on a pair of four-bar linkages as previously describe with respect to glider chair 20.

As presently preferred, glider chair 320 employs extended front and rear glide links 390, 392 to provide a smooth and relatively flat gliding motion relative to base glide assembly 332 and base 336. More specifically, as best seen in FIG. 18, glide uprights 395 extend upwardly from support frame 396 into the interior volume defined by seat deck 326. Upper pivot pins 388 and an upper portion of front and rear guide links 390, 392 are disposed within the interior volume defined by seat deck 326. Lower pivot pins 386 and a lower portion of front and rear glide links are extended below seat deck 326. As such, chair frame 322 is operably coupled to universal glide bracket 330 at a location disposed between lower pivot pin 386 and upper pivot pin 388. This allows for the use of extended front and rear glide links 390, 392 having a length which extends approximately between the upper edge of left side rail 340 and the lower edge of base glide assembly 332 to achieve a smooth and relatively flat gliding motion, while maintaining the appropriate positioning of seat deck 326 to base 336. As presently preferred, front glide links 390 are approximately 6.5 inch in length as defined between lower and upper pivot pins 386, 388. Similarly, rear glide links 392 are approximately 5.5 inches in length. Apertures 398 formed in lower vertical flange 378 receive front and rear rubber-coated glide stops 400 which define the forward and rearward limits of glider chair 322 in a manner similar to that described with respect to glider chair 20.

As best seen in FIG. 15, sinuous seat springs 402 extend between front and rear cross members 342, 344 of seat deck 326 to provide support for a seat cushion and a seated occupant. Referring now to FIGS. 15 and 18, seat spring support bracket 404 provides means for vertically supporting the outermost seat springs to maintain clearance for the range of motion of front and rear glide links 390, 392. As best seen in FIG. 18, seat spring support bracket 404 is secured to right side rail 340 and extends upwardly to engage sinuous seat spring 402. More specifically, vertical wall portion 406 having a pair of apertures formed therethrough receives self-tapping, self-countersinking threaded fasteners 408 to secure seat spring support bracket 404 to right side rail 340. Inwardly stepped portion 410 appropriately positions horizontal flange portion 412 in a lateral direction such that horizontal flange portion 412 engages and supports sinuous seat spring 402. A threaded fastener 414 having enlarged head portion 416 captures sinuous seat spring 402 for securement to seat spring support bracket 404.

As previously discussed, the present invention is designed to utilize non-precision bearings in conjunction with glide links 390, 392. A lateral load generated by the weight of the chair frame 322 and a seated occupant therein is applied to front and rear glide links 390, 392 and reacted through the non-precision bearings for preloading the bearings to remove the clearance and play therefrom. More specifically, the weight of chair frame 322 and an occupant seated therein causes glide uprights 395 to deflect at the cantilevered ends. This deflection, in combination with the cambered, i.e., non-parallel, orientation of front and rear glide links 390, 392 with respect to the glide uprights 395 induces a lateral load on the glide mechanism which preloads the upper and lower bearings thereof to remove the clearance and play therein. Likewise, front and rear glide links 390, 392 may be laterally loaded by properly dimensioning seat deck 326 relative to universal glide brackets 330. More specifically, the distance between left and right side rails 338, 340 of seat deck 326 (as indicated in FIG. 15 as l1) is slightly greater than the distance between upper vertical flange portions 376 of right and left universal glide brackets 330 (indicated as in FIG. 15 as l2). Accordingly, when left or right side rails 338, 340 are secured to universal glide bracket 330, an outwardly directed laterally load is induced within the front and rear glide links 390, 392, thereby removing the clearance and play in the bearing and providing smooth gliding movement.

To further enhance this aspect of the present invention, universal glide bracket 330 should be sufficiently stiff to prevent deformation during lateral loading of front and rear glide links 390, 392, thereby transferring the lateral loads from chair frame 322 through universal glide bracket 330 to the bearings of front and rear glide links 390, 392. In this regard, universal glide bracket 330 is provided with a pair of generally vertically extending ribs 394. Ribs 394 extend from lower vertical flange portion 378 through horizontal surface 372 to upper vertical flange portion 376. Accordingly, ribs 394 prevent relative bending at the intersections between horizontal surface 372 and upper and lower vertical flange portions 376, 378.

As should be appreciated from the detailed description set forth above, the glider chair of the present invention provides an improved glider mechanism which suspends a chair frame above a base assembly to permit gliding movement therebetween and which further enables a modular chair frame to be readily adapted into the glider chair in a simple, efficient and smoothly and quietly operating manner. While the foregoing discussion discloses and describes various exemplary embodiments of the present invention, one skilled in the art will readily recognize from such discussion, and from the accompanying drawings and claims, that various changes, modifications and adaptations can be made therein without departing from the spirit and scope of the invention as defined in the following claims.

What is claimed is:

1. A glider chair comprising:

a base glide assembly having a base supported on a floor surface;

a glider mechanism including a left four bar linkage and a right four bar linkage, each of said left and right four bar linkage having a glide bracket, a front glide link having a first end pivotally connected at a front upper pivot to said base glide assembly and a second end pivotally connected at a front lower pivot to said glide bracket, and a rear glide link having a first end pivotally connected at a rear upper pivot to said base glide assembly and a second end pivotally connected at a rear lower pivot to said glide bracket;

a chair frame having a pair of side walls interconnected by a seat deck, said chair frame operably coupled to said glide bracket for permitting gliding movement of said chair frame with respect to said base glide assembly;

a seat spring secured to said seat deck above said glider mechanism; and a seat spring support bracket interdisposed between said seat deck and said seat spring to locally support said seat spring above said glider mechanism.

2. The glider chair of claim 1 wherein said chair frame is operably coupled to said glide bracket at a location disposed between an upper limit and a lower limit, said upper limit defined by a line extending through said front and rear upper pivots and said lower limit defined by a line extending through said front and rear lower pivots.

3. The glider chair of claim 1 wherein said front and rear upper pivots of said front and rear glide links are positioned within an interior volume defined by said seat deck.

4. The glider chair of claim 1 wherein said front and rear upper pivots of said front and rear glide links are located laterally adjacent an upper edge of said seat deck within said interior volume defined by said seat deck.

5. The glider chair of claim 1 further comprising:

said seat deck including a pair of side frame members interconnected by a front cross member and a rear cross member, a plurality of seat springs extending between said front and rear cross members; and said seat spring support bracket including a vertical flange portion secured at a first end to one of said pair of side frame members, a horizontal flange portion extending laterally inwardly from a second end of said vertical flange portion and a spring retainer secured to said horizontal flange portion and engaging at least one of said plurality of seat springs.

6. The glider chair of claim 1 wherein said front and rear lower pivots of said front and rear glide links are located laterally adjacent said base glide assembly.

7. The glider chair of claim 1 wherein the length of said front and rear glide links is approximately equal to a distance between an upper edge of said seat deck and a lower edge of said glide base assembly.

8. The glider chair of claim 1 wherein said front glide links are greater than 6" in length and the rear glide links are greater than 5" in length.

9. The glider chair of claim 8 wherein said front and glide links are approximately 6.5" in length and the rear glide links are approximately 5.5" in length.

10. The glider chair of claim 1 further comprising a swivel plate interdisposed between said base and said base glide assembly for permitting rotational movement of said base glide assembly with respect to said base.

11. A glider chair comprising:

a base glide assembly having a base supported on a floor surface;

a glider mechanism including a left four bar linkage and a right four bar linkage, each of said left and right four bar linkage including a glide bracket having a first vertical flange portion and a second vertical flange portion offset laterally outwardly from said first vertical flange portion by a horizontal flange portion, a front glide link having a first end pivotally connected at a front upper pivot to said base glide assembly and a second end pivotally connected at a front lower pivot to said first vertical flange portion of said glide bracket, and a rear glide link having a first end pivotally connected at a rear upper pivot to said base glide assembly and a second end pivotally connected at a rear lower pivot to said first vertical flange portion of said glide bracket; and a chair frame having a pair of side walls interconnected by a seat deck, said chair frame secured to said second vertical flange portion of said glide bracket for permitting gliding movement of said chair frame with respect to said base glide assembly.

12. The glider chair of claim 11 wherein said glide bracket comprises a horizontal tab extending laterally outwardly from said second vertical flange for engaging and supporting a bottom edge said chair frame.

13. The glider chair of claim 12 wherein said glide bracket comprises adjustment means for adjustable locating said chair frame with respect to said glider mechanism.

14. The glider chair of claim 11 further comprising loading means for laterally loading said glider mechanism.

15. The glider chair of claim 14 wherein said loading means comprises a camber angle provided between said pair of front glide links and said base glide assembly and between said pair of rear glide links and said base glide assembly, whereby a vertical load applied to said glide bracket induces lateral loading of said glider mechanism.

16. The glider chair of claim 14 wherein said loading means comprises:

said base glide assembly having a base frame, a pair of front glide uprights cantilevered upwardly from said base frame, and a pair of rear glide uprights cantilevered upwardly from said base frame; and said pair of front glide links spaced laterally outwardly from said pair of front uprights; and said pair of rear glide links spaced laterally outwardly from said pair of rear uprights;

whereby a vertical load applied to said glide bracket induces lateral loading of said glider mechanism.

17. The glider chair of claim 14 wherein said glide bracket further comprises a rib formed in said glide bracket and extending vertically from said first vertical flange portion through said horizontal flange portion to said second vertical flange portion.

18. The glider chair of claim 14 further comprising said seat deck having a pair of side frame members spaced laterally apart by a front cross member and a rear cross member to define a chair width, said chair width being greater than a glider mechanism width defined by a distance between said second vertical flange portions of said left and right four bar linkages, such that a lateral load is applied to said glider mechanism when said glider mechanism is secured to said seat deck.

19. The glider chair of claim 11 wherein said glide bracket further comprises a rib formed in said glide bracket and extending vertically from said first vertical flange portion through said horizontal flange portion to said second vertical flange portion.

20. The glider chair of claim 11 further comprising a swivel plate interdisposed between said base and said base glide assembly for permitting rotational movement of said base glide assembly with respect to said base.

21. A glider chair comprising:

a base supported on a floor surface;

a base glide assembly disposed on said base and having a pair of front uprights each of said pair of front uprights having a fixed end secured to said base and a free end extending upwardly from said base, and a pair of rear uprights, each of said rear uprights having a fixed end secured to said base and a free end extending upwardly from said base;

a chair glide assembly including a subframe, a glide bracket secured to said subframe, and a glider mechanism having a pair of front glide links pivotally connected at a first end to said free end of said pair of front uprights opposite said base and pivotally connected at a second end to said glide bracket, and a pair of rear glide links pivotally connected at a first end to said free end of said pair of rear uprights opposite said base and pivotally connected at a second end to said glide bracket; and a chair frame having a pair of side walls, a front support member interconnected to a front portion of said side walls, a rear support member interconnected to a rear portion of said side walls, and a seat assembly having a seat member and a seat back, said chair frame secured to said glide bracket for permitting gliding movement of the chair frame with respect to the base glide assembly.

22. The glider chair of claim 21 further comprising a glide stop assembly disposed on said glide bracket selectively positionable between an unlocked position to permit gliding movement of said chair frame with respect to said base and a locked position to prevent gliding movement of said chair frame with respect to said base.

23. The glider chair of claim 22 wherein said glide stop assembly is independent of said glider mechanism.

24. The glider chair of claim 23 wherein said glide stop assembly comprises a left glide stop linkage and a right glide stop linkage, each of said right and left glide stop linkages having a front glide stop link pivotally connected to said glide bracket and a rear glide stop link pivotally connected to said glide bracket, said front and rear glide stop links being rotatably positionable from a generally vertical unlocked position to a generally horizontal locked position such that said front glide stop link engages said front glide link and said rear glide stop link engages said rear glide link.

25. The glider chair of claim 24 wherein at least one of said front and rear glide stop links comprises a first link pivotally connected at a first end to said glide bracket and a second link extending from said first link for permitting adjustment in the length of said at least one of said front and rear glide stop links.

26. The glider chair of claim 25 wherein said glide stop assembly further comprises a follower surface formed on an edge of said front and rear glide links and a cam roller disposed at the end of said front glide stop links and said rear glide stop links for engaging said follower surface to lock out said glide mechanism.

27. The glider chair of claim 21 further comprising a glide limit operably associated with said at least one of said pair of front and rear glide links to define a range of gliding movement of said chair frame with respect to said base.

28. The glider chair of claim 27 wherein said glide limit comprises a front glide limit extending from said glide bracket for engaging said front glide link to define a forwardmost position of said chair frame with respect to said base and a rear glide limit extending from said glide bracket for engaging said rear glide link to define a rearwardmost position of said chair frame with respect to said base.

29. The glider chair of claim 28 wherein each of said front and rear glide limits comprise a stud extending from said glide bracket and a removable rubber cover disposed over said stud for engaging each of said front and rear glide links.

30. The glider chair of claim 21 further comprising a tilt control assembly operably coupling said chair frame to said subframe for providing tilting movement therebetween.

31. The glider chair of claim 30 wherein said tilt control assembly further comprises:

a pivot assembly pivotally coupling said chair frame to a rear portion of said subframe; and a tilt control linkage interconnected between said subframe and a front portion of said chair frame, said tilt control linkage selectively moveable to urge said front portion of said chair frame in an upwardly direction to rotate said chair frame about said pivot assembly, thereby tilting said chair frame with respect to said subframe.

32. The glider chair of claim 31 wherein a front portion of said chair frame is supported on said subframe and a rear portion of said chair frame is supported by said pivot mechanism when said glider chair is in a non-tilted position and wherein said tilt control linkage further comprises a compliant element interdisposed between said chair frame and said subframe when said chair frame is in said non-tilted position.

33. The glider chair of claim 31 wherein said tilt control linkage is selectively moveable in response to manipulation of an actuation mechanism for causing tilting movement of said chair frame with respect to said chair glide assembly.

34. The glider chair of claim 33 wherein said tilt control linkage further comprises:

a lift link pivotally connected at a first end to said front support member and pivotally connected to said subframe at a second end;

a lift lever having a first end pivotally coupled to said lift link and a second end operably coupled to said actuation mechanism for selectively rotating said lift lever, said lift lever being pivotally supported from said subframe such that rotation of said lift lever urges said lift link upwardly to tilt said chair frame with respect to said subframe.

35. The glider chair of claim 34 wherein said tilt control linkage is selectively moveable in response to reclining movement of said seat assembly.

36. The glider chair of claim 35 wherein said tilt control linkage comprises a lift link pivotally connected at a first end to said seat member and pivotally connected to said subframe at a second end, such that reclining movement of said seat assembly rotates said lift link to urge a forward portion of the seat member upwardly thereby tilting said chair frame relative to said subframe.

37. The glider chair of claim 35 further comprising a seat lock assembly selectively positionable between an unlocked position to permit reclining movement of said seat assembly and a locked position to prevent reclining movement of said seat assembly.

38. The glider chair of claim 37 wherein said seat lock assembly further comprises:

a lock pin disposed on said seat assembly; and a seat lock linkage interconnected between said seat assembly and said subframe, said seat lock linkage engaging said lock pin to prevent reclining movement of said seat assembly when in said locked position and disengaging said lock pin to permit reclining movement of said seat assembly when in said unlocked position.

39. The glider chair of claim 35 wherein said tilt control linkage is further selectively moveable in response to manipulation of an actuation mechanism for causing tilting movement of said chair frame with respect to said subframe, independent of and cumulative with tilting movement in response to said reclining movement of said seat assembly.

40. The glider chair of claim 39 wherein said tilt control linkage further comprises a lift lever having a first end pivotally coupled to said lift link and a second end operably coupled to said actuation mechanism for selectively rotating said lift lever, said lift lever being pivotally supported from said subframe such that rotation of said lift lever urges said lift link upwardly to tilt said chair frame with respect to said subframe.

41. The glider chair of claim 21 further comprising loading means for laterally loading said glider mechanism.

42. The glider chair of claim 41 wherein said loading means comprises a camber angle provided between said pair of front glide links and said pair of front glide uprights and between said pair of rear glide links and said pair of rear glide uprights, whereby a vertical load applied to said glide bracket induces lateral loading of said glider mechanism.

43. The glider chair of claim 42 wherein said loading means comprises:

said pair of front glide links and said pair of rear glide links spaced laterally outwardly from said pair of front and rear uprights.

44. The glider chair of claim 21 further comprising a swivel plate interdisposed between said base and said base glide assembly for permitting rotational movement of said base assembly with respect to said base.

45. The glider chair of claim 21 further comprising a leg rest assembly supported from said chair frame and operably coupled thereto for selectively moving said leg rest assembly between a retracted position and an extended position.

46. A glider chair comprising:

a base supported on a floor surface;

a subframe disposed on said base and having an upright extending upwardly therefrom;

a chair frame having a pair of side walls, a front support member interconnected to a front portion of said side walls, a rear support member interconnected to a rear portion of said side walls, and a seat assembly having a seat member, a seat back, and a swing link assembly pivotally interconnecting said seat back and said seat member and suspending said seat member within said chair frame to permit reclining movement of said seat assembly between an upright position and a reclined position;

a glide assembly operably coupling said chair frame to said subframe for gliding movement thereon, said glide assembly including a pair of front glide links and a pair of rear glide links, each of said glide links having a first end pivotally connected to said upright at an end opposite said base and a second end pivotally connected a glide bracket, said glide bracket coupled to said chair frame;

a glide stop assembly disposed on said glide assembly and operably coupled to an actuation mechanism for selectively positioning said glide stop assembly to directly engage at least one glide link of said pair of front glide links and said pair of rear glide links for preventing said gliding movement;

a tilt control assembly interconnecting said chair frame to said glide assembly to provide tilting movement therebetween, said tilt control assembly being operably coupled to said actuation mechanism for actuating said tilting movement; and a leg rest assembly supported from and operably coupled to said actuation mechanism for selectively moving said leg rest assembly between a retracted position and an extended position.

47. The glider chair of claim 46 wherein said tilt control assembly is selectively moveable in response to reclining movement of said seat assembly, and said glider chair further comprises a seat lock assembly interconnected between said glide assembly and said seat assembly and operably coupled to said actuation mechanism for selectively positioning said seat lock assembly from a locked position for preventing said reclining movement of said seat assembly and an unlocked position for permitting said reclining movement of said seat assembly.

48. A glider chair comprising:

a base supported on a floor surface;

a chair frame, a glider mechanism including a pair of front glide links and a pair of rear glide links interconnected between said base and said chair frame for permitting gliding movement of said chair frame with respect to said base, each of said glide links having a first end pivotally coupled to said base and a second end pivotally coupled said chair frame; and a glide stop assembly operably coupled to said glider mechanism and independent of said base, said glide stop assembly being selectively positionable between an unlocked position to permit gliding movement of said chair frame with respect to said base and a locked position such that said glide stop assembly directly engages at lest one glide link of said pair of front glide links and said pair of rear glide links to prevent gliding movement of said chair frame with respect to said base.

49. The glider chair of claim 48 wherein said glide stop assembly further comprises a glide stop linkage having a front glide stop link pivotally connected to said chair frame and a rear glide stop link pivotally connected to said chair frame, said front and rear glide stop links being rotatably positionable from a generally vertical unlocked position to a generally horizontal locked position such that said front glide stop link engages said pair of front glide links and said rear glide stop link engages said pair of rear glide links.

50. The glider chair of claim 49 wherein at least one of said front and rear glide stop links comprises a first link pivotally connected at a first end to said glide bracket and a second link extending from said first link for permitting adjustment in the length of said at least one of said front and rear glide stop links.

51. The glider chair of claim 50 wherein said glide stop assembly further comprises a follower surface formed on an edge of said front and rear glide links and a cam roller disposed at the end of said front glide stop links and said rear glide stop links for engaging said follower surface to lock out said glide assembly.

52. A glider chair comprising:

a base supported on a floor surface;

a chair subframe;

a glider mechanism interconnected between said base and said chair subframe for permitting gliding movement of said chair subframe with respect to said base;

a chair frame having a front portion engaging said chair subframe for support thereon when said glider chair is in a non-tilted position; and a tilt control assembly including a pivot bracket secured to said chair subframe, a pivot mount secured to said chair frame, and a tilt control linkage operably coupled between said chair subframe and said chair frame, said pivot mount cooperating with said pivot bracket to define a single pivot axis about which said chair frame tilts relative to said chair subframe, said tilt control linkage selectively moveable to urge said front portion of said chair frame in an upwardly direction out of engagement with said chair subframe and to rotate said chair frame about said single pivot axis for tilting said chair frame relative to said chair subframe.

53. The glider chair of claim 52 wherein said tilt control assembly further comprises a compliant element interdisposed between said front portion of chair frame and said chair subframe when said chair frame is in said non-tilted position.

* * * * *

UNITED STATES PATENT AND TRADEMARK OFFICE

CERTIFICATE OF CORRECTION

PATENT NO. : 5,765,913

DATED : June 16, 1998

INVENTOR(S) : Larry P. LaPointe, Jonathan R. Saul and Richard E. Marshall

It is certified that error appears in the above-indentified patent and that said Letters Patent is hereby corrected as shown below:

Col. 5, line 25, "a" should be --$\alpha$--.

Col. 14, line 38, "l1" should be --$\ell$1--.

Col. 14, line 42, "l2" should be --$\ell$2--.

Col. 17, line 66, Claim 26, "25" should be --24--.

Col. 18, line 58, Claim 35, "34" should be --30--.

Col. 19, line 38, Claim 43, "42" should be --41--.

Col. 20, line 48, Claim 48, "lest" should be --least--.

Signed and Sealed this

Thirteenth Day of April, 1999

*Attest:*

Q. TODD DICKINSON

*Attesting Officer*

*Acting Commissioner of Patents and Trademarks*